US010598002B2

(12) United States Patent
Sites

(10) Patent No.: US 10,598,002 B2
(45) Date of Patent: Mar. 24, 2020

(54) SAFETY INTERLOCK AND TRIGGERING SYSTEM AND METHOD

(71) Applicant: IdeasCo LLC, Venetia, PA (US)

(72) Inventor: Joseph Sites, Venetia, PA (US)

(73) Assignee: IdeasCo LLC, Venetia, PA (US)

( * ) Notice: Subject to any disclaimer, the term of this patent is extended or adjusted under 35 U.S.C. 154(b) by 88 days.

(21) Appl. No.: 15/695,239

(22) Filed: Sep. 5, 2017

(65) Prior Publication Data

US 2019/0071963 A1 Mar. 7, 2019

(51) Int. Cl.

| | |
|---|---|
| ***E21B 47/09*** | (2012.01) |
| ***E21B 43/119*** | (2006.01) |
| ***E21B 47/12*** | (2012.01) |
| *E21B 23/01* | (2006.01) |

(52) U.S. Cl.

CPC ..... *E21B 47/09* (2013.01); *E21B 43/119* (2013.01); *E21B 47/091* (2013.01); *E21B 47/0905* (2013.01); *E21B 47/124* (2013.01); *E21B 23/01* (2013.01)

(58) Field of Classification Search

CPC .... E21B 47/09; E21B 47/091; E21B 47/0905; E21B 43/119; E21B 23/01

See application file for complete search history.

(56) References Cited

U.S. PATENT DOCUMENTS

| | | | | |
|---|---|---|---|---|
| 4,572,293 | A | 2/1986 | Wilson | |
| 4,660,638 | A | 4/1987 | Yates | |
| 6,273,187 | B1 | 8/2001 | Voisin | |
| 6,333,700 | B1 | 12/2001 | Thomeer | |
| 7,066,261 | B2 | 6/2006 | Vicente | |
| 7,293,715 | B2 | 11/2007 | Bargach | |
| 7,385,523 | B2 | 6/2008 | Thomeer | |
| 9,366,134 | B2 | 6/2016 | Walton | |
| 2014/0076542 | A1* | 3/2014 | Whitsitt | E21B 34/14 166/250.1 |
| 2016/0289061 | A1 | 10/2016 | Brown | |

FOREIGN PATENT DOCUMENTS

| | | | |
|---|---|---|---|
| WO | WO2015118087 | A1 | 8/2015 |

* cited by examiner

*Primary Examiner* — Brad Harcourt

(74) *Attorney, Agent, or Firm* — Metz Lewis Brodman Must O'Keefe LLC

(57) ABSTRACT

An interlock system for use in a wellbore and method of using same, including a plurality of sensors configured to detect physical conditions within a wellbore. The sensors may be absolute locational sensors or relative locational sensors. Electronic signals are generated when sensors detect corresponding physical conditions. A processor derives location information from the electronic signals, and verifies location by comparison to pre-programmed reference information for each sensor. A trigger signal is generated when at least two location information have been verified, which is used to activate a downhole event. A timer may also be set with a calculated time delay before the trigger signal is generated. The interlock system operates independent of connection to any device at the surface of a wellbore, and may be attached to any equipment for deployment down a wellbore.

22 Claims, 18 Drawing Sheets

SAFETY INTERLOCK AND TRIGGERING SYSTEM AND METHOD

FIELD OF THE INVENTION

This invention relates to locational and activation systems, and more particularly, to systems and methods for determining the absolute and relative location of a device or mobile piece of equipment down a wellbore, and for activation of the device through a safety interlock system independent of mechanical surface connections.

BACKGROUND

Wells are used in the oil and gas industry to obtain fossil fuels and other fluids entrained in subterranean formations. Once a well is drilled, many types of equipment may be deployed in a well to perform tasks within the well, such as a perforating gun to detonate charges and create perforations through the wellbore and into the strata surrounding the wellbore to access the entrained natural resources, release or set a plug to obstruct a portion of the wellbore for isolation and further tasks, to apply materials to portions of the wellbore or well casing such as acid or cement, to perforate holes at specific locations of the wellbore or casing, or to activate a piece of remote equipment such as to provide signals, information, or log data in the wellbore or conditions at the downhole location. In these examples, precise location of the equipment within the well is critical to achieve optimal results, and in some cases, avoid dangerous conditions, such as from inadvertent detonation of a perforating gun too close to the surface. Despite the importance of precise location and safe activation, being able to determine the absolute and relative location of a piece of equipment within a wellbore and prevent inadvertent activation until the precise time or location needed still presents challenges.

For instance, in most settings, a wireline or slickline is used to lower the device downhole to the desired location. The most common way to determine the location of the device is by measuring from a surface device how much wireline or slickline has been sent down the wellbore. This is not always a reliable method of location determination, however, since the wireline or slickline may encounter obstacles in the wellbore, becoming snagged or wrapped around the obstacle before becoming freed for continued travel down the wellbore, or the surface cable length measuring devices could fail. Navigating the heel of a wellbore where it turns from a vertical orientation to a more horizontal orientation relative to the surface may also require releasing more wireline or slickline than corresponds to the distance traveled. Also, a wireline or slickline may be severed in the wellbore with or without knowledge of this occurrence at the surface where the line is being fed. In this case, the amount of line fed down the wellbore is entirely divorced from the location of the device being lowered.

Because of the many problems associated with using wireline or slickline, some devices have been developed for automatic or remote activation so a reference to the surface is not needed. However, these devices are rife with safety concerns. For instance, remote detonators for perforating guns are known, but they often rely on preset timers or pressure activation for detonation. Detonation is therefore based on calculations of where the perforating gun should be in the wellbore after a particular amount of time traveling at a particular speed, for example, but these are only calculations and may not accurately reflect the actual location of the perforating gun. For instance, the perforating gun may move slower through the wellbore than expected, such as from encountering an obstacle, or it may move faster than calculated. Not knowing the actual location of the perforating gun can result in perforations being made at unintended locations or even detonation dangerously close to the surface.

Efforts have been made to develop sensors that can provide locational information of a device. There are many different types of sensors, both active and passive, that have been used to determine the location of a piece of equipment within a wellbore. For example, U.S. Pat. Nos. 7,385,523 and 6,333,700 to Thomeer, et al. disclose the use of non-acoustic transponders affixed to the casing of a wellbore and a mobile tool, such as a perforating gun. The transponders emit identifying codes and communicate with one another when in proximity to each other. The perforating gun is fired when a transponder detects a matching code. The transponder types can include RFID recognizing unique identifying sequences or codes, magnetic pulse, magnetic field strength or polarity, magnetically encoded information, or optical transponders such as lasers detecting reflected patterns. Multiple transponders can be used at different locations along the well to permit the identification of the location of the tool. However, Thomeer requires only a single detection event to activate the tool. It provides no protection against accidental firing.

Similarly, U.S. Pat. No. 9,366,134 to Walton, et al. also discloses the communication between active transitory nodes on a movable tool and corresponding stationary nodes located in the wellbore to determine the position of the movable tool within the wellbore. Location of the tool may be determined as either absolute location by addressing stationary nodes, or relative location by counting nodes as they are passed. Various sensor types are disclosed, including temperature, pressure, magnetic fields, and fluid flow, all of which provide information on the conditions within the well. The tool, such as a perforating gun, is introduced into a wellbore in an inactive state, and is only turned to an active state upon reaching a certain depth or location. While the various sensors can be used to determine the location of the perforating gun before detonation, there is no safety mechanism to prevent accidental firing.

On the other hand, International Patent Application Publication No. WO 2015/118087 to Van der Ende discloses a system to avoid unintentional detonation of a perforating gun, such as from RF interference. The system uses information from various sensors provided to a code-activated switch at the surface to unlock the switch and create a safe firing window. Various sensors collect data on temperature, pressure, and time of the movement of the perforating gun, and transmit this data up a wireline to the code-activated switch at the surface. A key encrypted with physical and electronic settings must match the physical array of switches in the tool to unlock the system and permit firing of the device. However, no reference is made to absolute or relative positioning of the perforating gun, but rather focus is on the lockout mechanism which prevents accidental firing. Similarly, U.S. Pat. No. 6,273,187 to Voisin, Jr., et al. discloses a detonation system which detects pressure and temperature and uses a timer interlock to create a window for possible detonation. However, it does not determine the location of the device within the wellbore.

Therefore, there remains room for improvement for a way to determine the absolute and relative location of a device within a wellbore, and to coordinate this location information with a safety interlock system to prevent inappropriate activation or firing of the device when not at the desired location, all without reference or communication to the surface.

DESCRIPTION OF THE DRAWINGS

Like reference numerals refer to like parts throughout the several views of the drawings.

DETAILED DESCRIPTION

As shown in the accompanying drawings, the present invention is directed to an interlock system and method that can be used to identify the absolute and relative location of associated equipment and cause a downhole activity to occur automatically upon verification of the location of the equipment. For instance, the interlock system and method can be used with a perforating gun for automatic detonation and perforation once a preselected location within a well casing is reached. Detonation instruction from the surface of the well is not needed, and hence the system and any associated device or equipment may be independent of tubing, wireline, slickline or other similar structure. To protect against premature or accidental detonation, the interlock system includes a number of sensors, such as at least two or more with a preferred embodiment of three sensors of different types, that must all register the detection of their respective properties or physical conditions and be validated before detonation or other downhole activity can occur. A time delay may also be calculated and run once all detected events have been verified. The present invention allows a piece of equipment, such as a perforating gun, plug, or other activatable well equipment, to be deployed down a well and activated automatically without connection to the surface. Wireline, slickline, cables, guides, tubing, and other devices that typically extend down a well from the surface to provide feedback information and instructions are not needed with the present invention, due to automatic activation upon determining and confirming the location of the device and/or associated equipment. This circumvents many of the problems associated with such a wireline, such as the wireline becoming tangled, broken, or stuck at sometimes an indeterminable depth within the well, causing hours of delay in the well production process.

Figure 1:
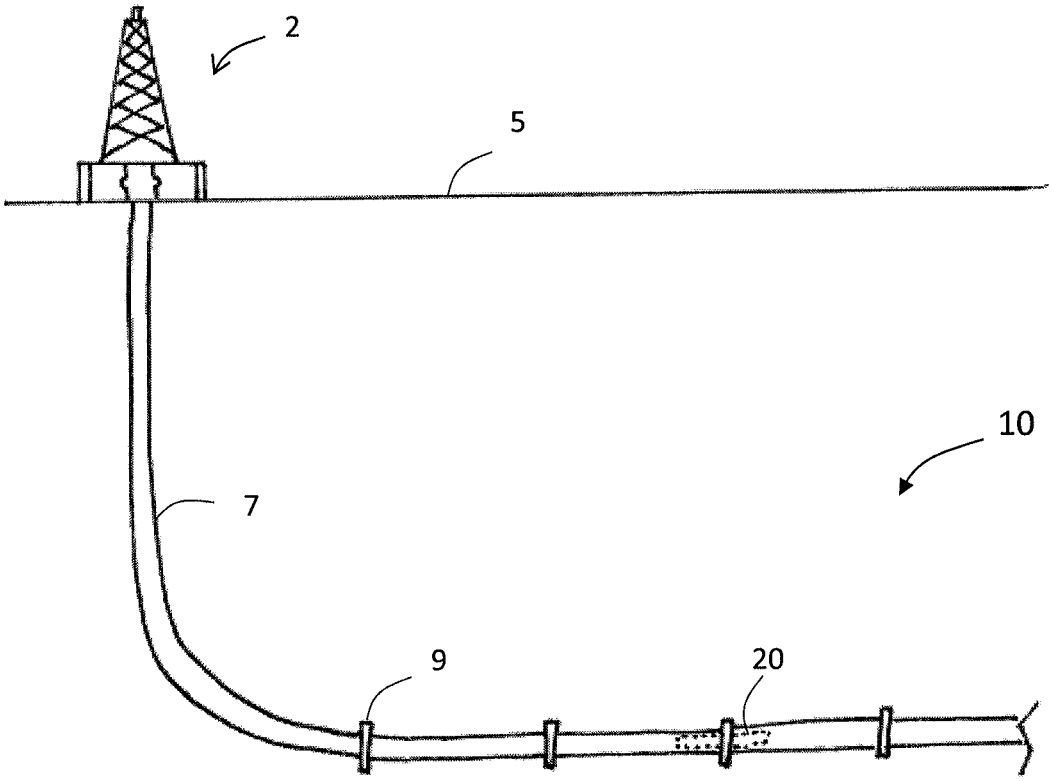
FIG. 1 is a schematic diagram of one embodiment of the locational system of the present invention in relation to a wellbore and rigging.

Turning now to the Figures, the present invention is directed to a locational system 10, as shown in FIGS. 1-4. The locational system 10 includes a piece of equipment 20 having an interlock system 30 installed thereon or therein, and a plurality of location identifiers 14 at preselected known locations in the wellbore. For instance, in the well rig 2 setting as shown in FIG. 1, a wellbore is drilled from the surface 5, and a casing 7 may be installed in the wellbore to isolate the wellbore from the producing formations. This casing 7 is comprised of a series of pipes or tubes which are joined together at collars, or nodes 9, to span the length of the well. As used herein, "collar" and "node" may be used interchangeably to mean the joints or connections containing location identifiers along a wellbore casing 7. In some embodiments, the node 9 may be made of the same material as the casing 7, such as carbon steel, stainless steel, aluminum, titanium, fiberglass, or other materials. In other embodiments, the node 9 may be made of a different material than the casing 7. The node 9 may be threaded or smooth, and provides a fluidic seal between adjoining sections of casing 7 to provide hydraulic isolation of the materials within and outside the wellbore.

Figure 2:
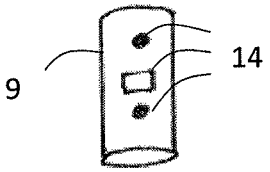
FIG. 2 is a schematic diagram of one embodiment of a node of the system.
Figure 3:
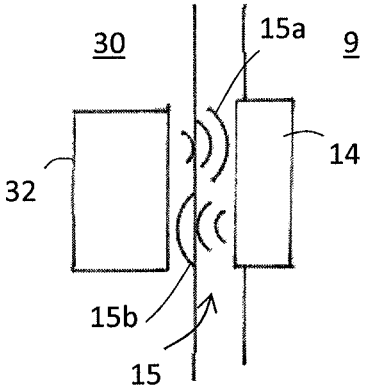
FIG. 3 is a schematic diagram of the interaction between a sensor and corresponding location identifier of the locational system.

In some embodiments, location identifiers 14 may be placed at known locations throughout the nodes 9 and/or casing 7 during installation of the casing 7. For instance, location identifiers 14 may be placed at 14,000, 2,000 and 3,500 feet below the surface. The location identifiers 14 may be placed on or within the casing 7, or on or within a node(s) 9. For example, a plurality of nodes 9 may each include at least one location identifier 14 disposed therein, as shown in FIG. 2. In other embodiments, location identifiers 14 are locations naturally occurring along the casing 7 or in the strata surrounding the wellbore. In such embodiments, the location identifiers 14 are not selectively placed, but may be naturally occurring locations that can be mapped by appropriate detection devices during or after the installation of the casing so that spikes in various physical conditions, such as radiation, magnetism, and electrical properties, can be determined and used in programming the interlock system 30, as described in greater detail below. Each location identifier 14 corresponds to a different sensor 32 on the interlock system 30. When the interlock system 30 passes by the location identifier 14, the corresponding sensor 32 registers the location identifier 14, as shown in FIG. 3. Because the position of the location identifier 14 is already known, being either set at a preselected position of known depth of the well casing 7 or mapped to a known location within the well, the location of the interlock system 30 is also known when the corresponding location identifier 14 is registered. In some embodiments, each of the location identifiers 14 along the well may be of different types, such that each is identified by a different sensor 32. In other embodiments, some of location identifiers 14 may be of the same type, but may each have a unique identifying signature or code such that they are registered by the sensor 32 as different location identifiers 14.

By way of illustrating example, signals 15 may pass between the corresponding sensor 32 and location identifier 14 to enable the sensor 32 to register the location identifier 14. The signals may be active or passive, and can be transmitted and/or received from either the sensor 32 or the location identifier 14. For example, in at least one embodiment the sensor 32 may be a transducer that emits active signals 15*a* as the equipment 20 having an interlock system 30 is maneuvered through the well casing 7. The location identifier 14 receives and returns a response signal 15*b*, which is in turn received by the sensor 32. Accordingly, the location identifier 14 remains passive until it receives a signal 15 from a corresponding sensor 32. The location identifier 14 may then either passively reflect back or actively transmit a response signal 15*b* back to the sensor 32. This may be the case where an RFID transducer is the sensor 32, and a corresponding RFID tag is the location identifier 14. In such an example, the signals 15 between the sensor 32 and location identifier 14 may be radio waves. This is but one illustrative example, and is not meant to be limiting in any way. Various sensors 32 are discussed in greater detail below, and each has a corresponding type of location identifier 14 that it recognizes.

It should also be appreciated that any combination of the sensor 32 and corresponding location identifier 14 may be active or passive. For instance, in some embodiments, as in the example above, the sensor 32 is active and the location identifier 14 is passive. In other embodiments, the location identifier 14 may be active and the corresponding sensor 32 is passive. In still other embodiments, both the sensor 32 and corresponding location identifier 14 are active. In further embodiments, both the sensor 32 and corresponding location identifier 14 may be passive.

Figure 4:
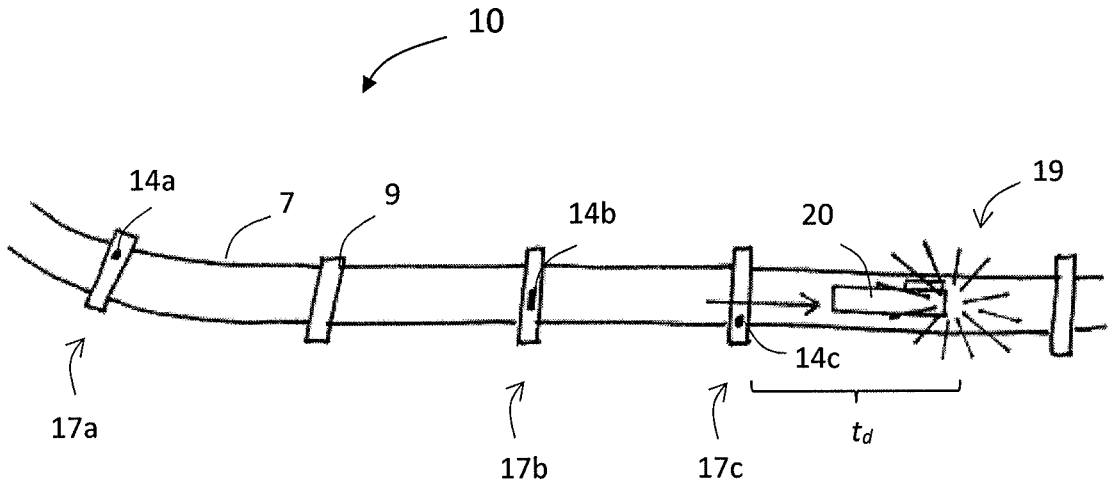
FIG. 4 is a schematic diagram of an embodiment of the locational system depicting the interlock system for activation of a locatable equipment.

The act of a sensor 32 registering a corresponding location identifier 14 is defined as a detection event 17. FIG. 4 illustrates the safety interlock aspect of the locational system 10. As a piece of locatable equipment 20 or other device having a interlock system 30 moves through the wellbore, detection events 17 are registered each time a sensor 32 passes by and registers a corresponding location identifier 14*a,b,c*. For instance, a first detection event 17*a* occurs when a first sensor 32*a* registers a corresponding location identifier 14*a*. A second detection event 17*b* occurs when a second sensor 32*b* registers a corresponding location identifier 14*b*. A third detection event 17*c* occurs when a third sensor 32*c* registers a corresponding location identifier 14*c*. In some embodiments, a single sensor 32 may detect a plurality of detection events 17*a,b,c* that are all of a common type of detection event. For instance, a sensor 32 that is configured to detect RFID may detect various RFID tags that are each separate location identifiers 14 along the wellbore. A magnetic sensor 32 may detect various unique or distinguishable magnetic signatures as different detection events 17*a,b,c*. These are but a few examples for illustrative purposes, and should not limit the sensor 32 in any way.

The interlock system 30 is configured to automatically activate a downhole activity 19, but only once a preselected threshold number of detection events has occurred and been verified. This prevents premature and accidental activation of the downhole activity. For instance, in the embodiment shown in FIG. 4, three detection events 17 may be required to have occurred and been verified before the interlock system 30 will activate. Any number of detection events may be required by the system 10 and/or interlock system 30 before activation of a downhole activity 19, and may be programmed into the interlock system 30 prior to being deployed into the well. For instance, the threshold number of detection events may be as low as 1 and as high as the number of sensors 32 present in the interlock system 30. In some embodiments, the threshold number of detection events is at least 2, or at least 3, or in the range of 3-10 or 3-5. As depicted in FIG. 4, the threshold number of detection events is 3.

In some embodiments, automatic activation of the downhole activity 19 may occur as soon as the threshold number of detection events occurs. In other embodiments, a time delay $t_d$ may be calculated based upon the velocity or speed of the interlock system 30 when the threshold number of detection events is reached, such as determined by an accelerometer or inertial measurement unit, and the distance to the desired site of activation. A timer may be set to run for the time delay $t_d$, and the automatic activation of the downhole activity 19 occurs once the time delay $t_d$ has expired.

Figure 5:
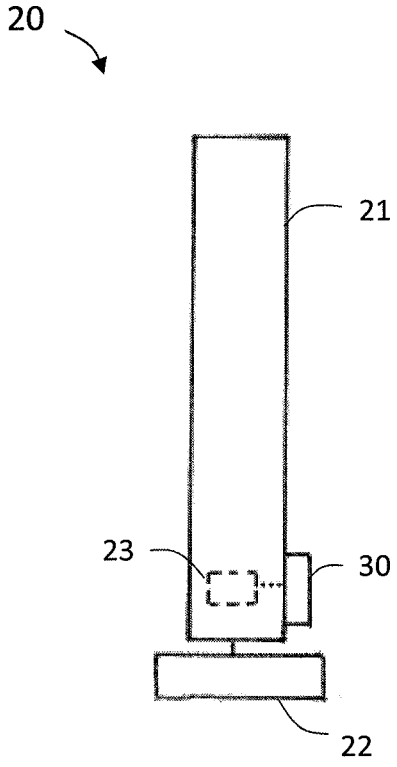
FIG. 5 is a schematic diagram of one embodiment of a locatable equipment which is a perforating gun.

The downhole activity 19 may be any activity that can or should occur at a particular downhole location within a well. For instance, in at least one embodiment, the downhole activity 19 is perforation of the casing 7. In such embodiments, the locatable equipment 20 may be a perforating gun 21 which carries an interlock system 30, as in FIG. 5. When the threshold number of detection events is reached and verified, the interlock system 30 is activated, which in turn activates an activation assembly 23 connected thereto, which in the case of a perforating gun is a detonation assembly. The detonation assembly may have its own processor, power source, and timing mechanism to control detonation of the explosive material that the perforating gun 21 carries. The interlock system 30 may be attached to the interior or exterior of the perforating gun 21 casing. In some embodiments, the interlock system 30 is integrated with the housing of the locatable equipment 20, such as the perforating gun 21 casing or plug 22 casing. In further embodiments, the interlock system 30 may be spread out along the length of the locatable equipment 20, and may wrap at least partially around the locatable equipment 20. The interlock system 30 may be located anywhere along the length of the locatable equipment 20, such as at the leading end, the trailing end, and anywhere along the length and/or circumference of the locatable equipment 20.

The locatable equipment 20, such as a perforating gun 21, may also include a centralizer in some embodiments to maintain radial position within the wellbore during travel, such as when ultrasonic vibration is being used as a physical condition being detected. In some embodiments, the centralizers may be mechanical in nature with extensions that are radially spring-loaded and bias against the inside of the casing 7 to keep the tool centralized therein. In other embodiments, the centralizer may have a fixed extension(s), such as a disc or fin, sized to fill the void space between the perforating gun 21 and the internal diameter of the casing 7. For example, if the inner diameter of the casing 7 is five inches and the outer diameter of the locatable equipment 20 is three inches, the centralizer may extend one inch from the surface of the locatable equipment 20 to keep the locatable equipment 20 positioned equidistant from the casing 7. The centralizer is positioned along the locatable equipment 20 to avoid interfering with the sensors 32 of the interlock system 30, and may be positioned to at least partially circumferentially surround the locatable equipment 20 or extend therefrom at intervals around the perimeter of the locatable equipment 20.

Figure 6:
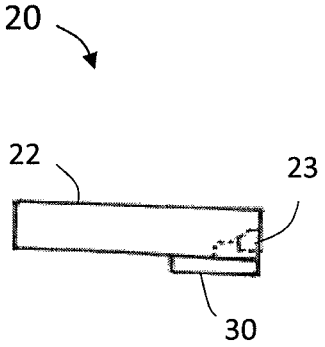
FIG. 6 is a schematic diagram of one embodiment of a locatable equipment which is a plug.

In other embodiments, the downhole activity 19 may be the setting of a plug 22. For instance, the locatable equipment 20 may be a plug 22, as in FIG. 6, or may include a plug 22, as in FIG. 5. When the threshold number of detection events is reached, the interlock system 30 is activated, which in turn activates an activation assembly 23, which in the case of a plug 22 is a deployment mechanism that deploys and sets the plug 22 in the well. The plug 22 may be any type of plug useful in the oil and gas industry, such as but not limited to a composite plug for isolating portions of the well. In some embodiments, the plug 22 may also include a centralizer to maintain the radial position of the plug 22 within the wellbore during travel, but is positioned to avoid interfering with the sensors 32 of the interlock system 30. The interlock system 30 may be found on the plug as shown in FIG. 6 or may be attached above or below the plug external to the tool or internal to the tools associated with setting the plug in the wellbore.

In still other embodiments, the downhole activity 19 may be releasing an item, such as a ball to plug a particular hole at a particular location within the well, or to release and/or apply chemicals such as acid or cement to particular points within the wellbore or casing 7, such as for pinpoint isolation, clean-up, correction, or other treatment of the well casing 7. This delivery system provides a targeted application of materials to the precise locations where they are needed, even if they are far downhole, thus enabling savings on cost and preventing waste of materials.

In further embodiments, the downhole activity 19 may be activating the locatable equipment 20, which may be a tool used in downhole applications. For example, the locatable equipment 20 may be a logging tool that can be used to log information about the well, but is desired to only log information on certain regions of the well, at certain depths of the well, or to save the battery life of the logging tool or available memory space required to store the logged data. To avoid running the logging tool during the entire well, which could cause the battery to run out or obtain large amounts of irrelevant data, the interlock system 30 can be added to the logging tool to turn it on and begin logging information only once the threshold number of detection events has occurred, thus ensuring the appropriate region of the well has been reached. In still other embodiments, the locatable equipment 20 may be a milling tool, which can be activated as the downhole activity 19 to drill into the casing 7 at a desired point in the well, such as at 13,500 feet for example. In still other embodiments, the locatable equipment 20 may be an electrical device that sends a signal to the casing 7 or back to the surface when activated. The signal could be an electrical pulse, electrical current, mechanical or pressure pulse or series of acoustic pulses that travels through the metal of the casing or the fluid of the wellbore to be detected on the surface. For example, the locatable equipment 20 may be a sound transmitter that generates sound waves when activated which travel through the wellbore fluid or casing back to the surface. This is but one illustrative example, and is not intended to be limiting in any way.

The interlock system 30, shown in FIG. 7, will now be described in greater detail. The interlock system 30 includes a plurality of sensors 32. The sensors 32 may be absolute locational sensors or relative location sensors. For instance, sensors 32 that are absolute locational sensors may be configured to correspond to location identifiers 14 located at known locations within the wellbore or casing 7. These sensors 32 are each configured to detect certain physical conditions or properties when in proximity to the corresponding location identifier 14 to determine the location of the system 30 and the associated equipment 20 within a well. A detection event from an absolute location sensor may therefore occur when in proximity to the corresponding location identifier 14, and may be defined as occurring when the presence of the corresponding physical condition is detected, or as when a particular signature, code or amount indicative of the physical condition is received. The physical condition may be one of radio-frequency; magnetic field; radiation; ultrasonic wave; sound wave; electrical property such as conductance, resistance, impedance, or inductance; or spatial orientation. Sensors 32 that are relative locational sensors provide location information of the interlock system 30 or associated device relative to some predetermined point, such as when a particular measurement commenced, and may or may not be relative to a location identifier 14. For example, relative locational information may be provided by distance, pressure, temperature, and spatial orientation. A detection event from a relative locational sensor may be defined as occurring when a measurement is taken.

In addition, the sensors 32 collectively form a safety interlock system in which a trigger signal to activate a downhole activity 19 cannot be generated until each of the sensors 32 registers its corresponding detection event and each is verified. The interlock system 30 includes at least two, but preferably at least three sensors 32, and may be any combination of absolute and relative locational sensors. As discussed above, the sensors 32 may be active units, actively transmitting signals 15 interrogating for the corresponding location identifier 14 or taking measurements, or may be passive and merely receive signals such as from the corresponding location identifier 14 or surrounding environment. In a preferred embodiment, the sensors 32 are part of the interlock system 30, which is attached to or associated with a mobile locatable equipment 20, and the corresponding location identifiers 14 are stationary within the wellbore, casing 7 and/or nodes 9 of the well.

Figure 7:
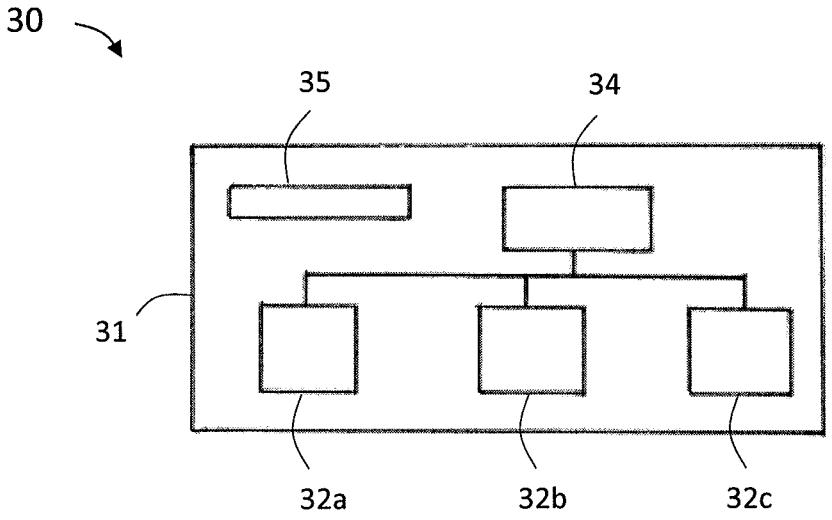
FIG. 7 is a schematic diagram of one embodiment of the interlock system of the present invention.
Figure 8:
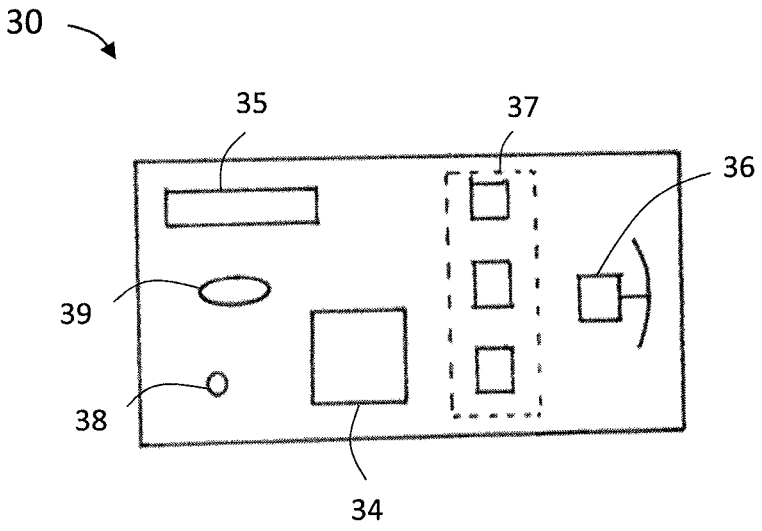
FIG. 8 is a schematic diagram of one example of the interlock system.

As depicted in the embodiment of FIG. 7, the interlock system 30 may include a first sensor 32*a* configured to recognize a first locational identifier 14*a*, a second sensor 32*b* configured to recognize a second locational identifier 14*b*, and a third sensor 32*c* configured to recognize a third locational identifier 14*c*. Additional sensors 32 may also be included in various embodiments to correspond with additional locational identifiers 14. The sensors 32 of the interlock system 30 may be of the same type, such as RFID or magnetic, that recognizes the same type of property, or may be of different types from one another that recognize different properties. For example, in the illustrative embodiment of FIG. 8, each of the sensors 32 is of a different type from one another and recognizes, detects, or measures a different property. The interlock system 30 in FIG. 8 includes an RFID sensor 36, a magnetic sensor 37, a pressure sensor 38, and an accelerometer 39 which senses or determines speed or rate of movement. This is just one non-limiting example provided for illustrative purposes. In other embodiments, two or more of the sensors 32 may be of the same type, such as RFID or magnetic, but are configured to recognize different unique signatures, tags or patterns from corresponding location identifiers 14.

The sensors 32 may be configured to pick up the presence of a physical condition, electromagnetic, magnetic, electrical, radiowave, radiative, ultrasonic, pressure, sound wave, temperature, or other particular property of a corresponding location identifier 14 or part of the wellbore. For instance, in some embodiments, at least one of the sensors 32 may be a radio-frequency identification (RFID) sensor. The RFID sensor may be active, such as an RFID interrogator that emits radiowave signals and receives radiowave signals reflected back from a passive tag, such as a location identifier 14 in the node 9 or casing 7. This arrangement allows the passive unit to be placed in a stationary location within the wellbore and requires no energy or expense to maintain. Only the sensor 32 is active, which is on the mobile locatable equipment 20, and therefore is only needed to be operational for distinct periods of time. The RFID sensor may be configured to emit radio-frequency signals in the range of 1-7 meters and receive radio-frequency signals in the range of 1-2 meters, such as but not limited to the STI-1 and STI-2 ultrahigh frequency RFID tag (Technologies ROI, LLC, Mauldin, S.C.). A particular frequency, pattern, or series of information may define an authentication code stored on the corresponding passive tag. For example, the authentication code may be comprised of any combination and length of text (in any language), numbers, hexadecimal, binary data, UPC code or serialization sequence. The tag or location identifier 14 may come pre-encoded with a unique authentication code, or the authentication code may be programmed at the site, such as with an RFID encoder. An active RFID sensor may include its own dedicated power source, such as a battery, and processor or microprocessor with memory to send and receive radio-frequency signals. The RFID processor may be programmable prior to deployment of the interlock system 30 to define the particular radio-frequency, range of frequency, or authentication code which the RFID sensor is keyed to recognize and register. Other radio-frequencies, patterns or codes will be ignored by the RFID sensor. In some embodiments, one RFID sensor may be programmed to register different unique identifying (UID) radio-frequencies, ranges, codes or patterns as described above. Different location identifiers 14 will each have a different UID associated with it. Receipt and registration of each different UID is a distinct detection event 17 indicating the presence of different location identifiers 14. In some embodiments, the downhole activity 19 may only occur once all UIDs have been detected or registered and verified. In other embodiments, the processor of the RFID sensor may perform a mathematical operation based on all of UIDs to create a PIN. For example, the PIN may be a sum of all the alphanumeric data of every UID between the surface and the desired activation location. In another example, the PIN may be a combination of particular portions of each UID which may be according to an algorithm, such as, by way of illustration, the fourth and fifth characters of a first UID, the second and twelfth characters of a second UID, the middle third of characters of a third UID, and the final five characters of a fourth UID. The PIN may be of any length and include any combination of text (in any language), numbers, hexadecimal, binary data, UPC code and serialization sequence, such as make up the UIDs. A predetermined PIN may be programmed into the processor 34 of the interlock system 30 prior to deployment. Generating of a trigger signal and subsequent activation of a downhole activity in at least one embodiment may only occur when all of the intended UIDs are detected and when the corresponding PIN is assembled from the UID authentication codes received by the RFID sensor. The longer or more complicated the PIN, the lower the possibility of achieving the PIN by chance. Therefore, the PIN may provide a second step of verification before activation can occur and may function as an additional safety measure.

In other embodiments, the reverse arrangement is contemplated, where the location identifier 14 is active and the RFID sensor is passive. In such embodiment, the active location identifier 14 may have its own power source, such as a local battery, and processor or microprocessor to emit radio-frequencies of a particular frequency, range or pattern. The corresponding passive RFID sensor receives and registers the radio-frequency, range or pattern in its processor 34. In still other embodiments, both the location identifier 14 and RFID sensor may be active or passive.

In some embodiments, at least one of the sensors 32 is a magnetic sensor that is configured to detect the presence of a magnetic field, or detect changes or fluxes in the strength or polarization of a magnetic field. For instance, in at least one embodiment, the magnetic sensor may be configured to detect the presence of a magnetic field to detect naturally occurring magnetic fields existing within the casing 7 because of the materials used in the casing 7. The magnetic field and changes to the field along the casing 7 may be logged ahead of time so the magnetic pattern of the casing 7 is known. When an interlock system 30 having a magnetic sensor is deployed down the well through the casing 7, the magnetic sensor may detect and register the magnetic field, and the absolute location of the interlock system 30 may be determined and verified by comparison to the known profile of the well. In addition, magnetic materials may be added to or removed from the casing or wellbore (if no casing is present) to create magnetic shifts or undulations. For example, metal alloys such as Inconel® may be wrapped around a collar at a node 9, or attached to or imbedded in the casing 7 or wellbore at predetermined points along the well. The magnetic sensor may be configured to detect the changes in the magnetic field, either increasing or decreasing, from the addition or removal of material to the casing 7 or surrounding wellbore over the native known pattern, and register this as a detection event 17.

In other embodiments, the magnetic sensor may be used to detect the presence of or a change in magnetic field caused by material added to the casing 7 or node 9 at particular preselected locations within the well. For instance, a coil may be added to a node 9. The equipment 20 carrying the interlock system 30 may also include a coil that generates an electromagnetic flux field when electrical current is applied to it, such as from a power source. When the equipment 20 with energized coil comes in proximity to the coil placed in the casing 7 or node 9, the electromagnetic flux field generated by the equipment 20 induces an electromagnetic field in the coil of the casing 7 or node 9. This creates a change in the naturally occurring magnetic field at the location of the coil, and a magnetic mark of known magnitude at a known location. The magnetic sensor may register this change in magnetic field as a spike, and the location may be determined based on the known preselected location of the corresponding coil as placed in the well. In still other embodiments, the magnetic sensor may register the changes in magnetic field from the naturally occurring formations of the strata surrounding the wellbore. For instance, the metals and minerals found in geographic formations, such as dolomite and shale, each have particular known magnetic signatures. The magnetic sensor may pick up the magnetic signatures of the surrounding formations from within the well. These may be additive over any magnetic signature of the casing 7, or may be detected more directly such as when no casing 7 is present, such as when the interlock system 30 is deployed down an unlined hole or well. Regardless of the type or source of magnetic field detection, the magnetic sensor may be used to provide absolute location information of the device 30 or associated locatable equipment 20.

In at least one embodiment, a Hall effect sensor may be used as such a magnetic sensor, registering the presence of a magnetic field when brought within proximity of the magnetic field. A Hall effect sensor can also be used to detect the presence of a magnet or material having a magnetic field, such as metals and alloys thereof, which are added to predetermined nodes 9 or particular points on the casing 7 or along the wellbore, to provide absolute location information of the device 30 or associated locatable equipment 20. As another example, a casing collar locator may be used as a magnetic sensor. The casing collar locator detects changes in magnetism of a well which correlates with the higher mass of the node 9. A signal may be transmitted to a processor 34 when a change in magnetism is detected. In other embodiments, the magnetic sensor is configured to detect a specific magnetic signature, such as provided by a location identifier 14 or tag placed at a known stationary location within the well, such as at a node 9 or point in the casing 7 of a particular depth. In some embodiments, the magnetic signature of the well is mapped in its entirety before deploying a piece of equipment 20 with an interlock system 30. A particular portion of the overall magnetic signature occurring at a known depth in the well is programmed as the magnetic signature which the magnetic sensor is configured to recognize. For instance, it may be determined that the magnetic field of the well measures 45 Gauss only at 14,000 feet below the surface. The magnetic sensor may be configured to recognize 45 Gauss so that when it is detected and registered, it is known that the interlock system 30 is at 14,000 feet. In this manner, the magnetic sensor can be used to provide absolute location information of the device 30 or associated locatable equipment 20.

In some embodiments, at least one sensor 32 is an electrical property sensor. Such a sensor may be configured to detect the presence of, or changes to, certain electrical properties of the well casing 7. For instance, the components of the well casing 7 will have innate conductance, impedance, inductance, and resistance to electrical current that can be detected and/or measured by appropriate instruments. The conductance of the casing may decrease at the collar or node 9, such as due to a gap present between the threads of the collar, and this decrease can be detected as the tool passes through the wellbore. Conversely, the impedance, resistance and inductance will increase at each collar as a result of the increased thickness at the collar. Therefore, the collar or node 9 may be detected by change in electrical property. In other embodiments, material can be introduced or added to preselected locations along the casing 7 or node 9 that have electrical properties and will increase or decrease the conductance, impedance, inductance, and/or resistance otherwise occurring at that location within the wellbore. For instance, insulating material may be added, creating a break in the electrical path and thereby providing detectable electrical event as a drop in conductance. In addition, a change in metallurgy of material used in the casing collars can create a change in electrical property. For instance, collars made of the alloy Inconel® may create a change in electrical properties when compared to a casing string made of low carbon stainless steel which has different conductance, impedance, inductance, and resistance properties. The amount of change in electrical property, such as a threshold change over a baseline reading for example, sufficient to be detected as an electrical event may be any measurable change increasing or decreasing, and will depend at least on the composition or thickness of the material that is in proximity to the electrical sensor. The relevant electrical property may be detected by instances of detection counted, or measured and compared to a baseline level to determine whether the change detected is significant enough to be considered an electrical detection event. The location is then determined by counting events or comparing to a known electrical signature, log, or reference map of the wellbore.

In some embodiments, at least one sensor 32 is a radiation sensor, such as a Geiger counter that is configured to detect and/or quantify radiation levels. All naturally occurring materials and structures made from materials have some inherent level of radiation. A radiation sensor can be used to detect radiation levels and/or quantify them to compare to a baseline level or merely count the number of occurrences that register over a predetermined threshold, such as 100 GAPI of gamma rays, for example. As before, any measurable or detectable change over the baseline may be sufficient to meet the predetermined threshold to count as a detection event. Radiation levels can be detected and/or measured for any radioactive material, such as but not limited to thorium, uranium, and potassium as may be detected and/or measured by instruments specific to each type of radioactive element. The radiation sensor may be specific not only to a specific element, but to a particular isotope as well. Naturally occurring materials may exhibit a particular level or signature of radiation, which may be unique to such materials, such as shale formations and other types of rock formations within or surrounding the wellbore, which can be detected through a casing 7. Based on a known radiation profile of the wellbore that may be mapped before deploying an interlock system 30, when a particular radiation profile or signature is detected, it is known that the interlock system 30 is located at the corresponding point in the wellbore having that known radiation profile or signature. As an example, measuring where naturally occurring spikes of high gamma ray over 200 GAPI (as compared to a baseline of 3 GAPI or 50 GAPI, for instance) through a particular rock formation at known depths provides location reference information for comparison of an interlock system 30. When the device 30 detects a high gamma ray over 200 GAPI, based on the number of spikes the device has encountered thus far, the absolute location of the device 30 at that point in time can be determined. The background levels of radiation along the wellbore or casing 7 will depend on the type of rock surrounding the wellbore, the composition of elements and minerals in the rock and the casing, and the different isotopes that may be present therein. Similarly, a tag or other location identifier 14 having a specific radiation signature may be placed at a known depth and location in the wellbore. When the radiation sensor registers a radiation signature matching that of the placed tag, the location of the interlock system 30 having such a radiation sensor is known to be the same location.

In other embodiments, at least one sensor 32 is an ultrasonic wave, sound wave, or mechanical pulse sensor, collectively referred to as sound devices that is configured to at least receive, and in some cases, transmit, sound vibrations. The sound vibrations may be any in the ultrasonic, subsonic, or audible sound range. For instance, ultrasonic transducers or sonic transducers such as the kinds used to measure casing thickness or the quality of cement bond to casing typically used in mapping wellbores, transmit ultrasonic and or sonic waves and measure the amount of time it takes to receive the reflected waves at each medium interface. The time will be greater when the sound wave passes through more material to reflect back to the transducer, and each change of medium will provide a different detectable reflection event. Therefore, collars or nodes 9 having a greater amount of material will take longer for the ultrasonic wave to reflect back to the sensor 32 within the wellbore than where the casing collars are thinner. Coils and other bulky items may be added to the nodes 9 or points along the casing 7 to increase the mass and exaggerate the difference, making it easier to detect them. Maintaining a constant distance from the edge of the wellbore or casing 7 is important when measuring sound vibrations, so a centralizer as previously described may be added to a locatable equipment 20 or interlock system 30 to ensure the equipment 20 or system 30 stays a constant distance from the casing 7, such as remaining in the center of the wellbore.

In some embodiments, at least one sensor 32 may be a sound device that is configured to detect ultrasonic waves, sound waves, clicks, mechanical pulses, or pressure pulses, which may collectively be referred to as "pulses," sent from a unit at the surface. The pulses may be generated at the surface and propagate through well media, such as at least one of the mud or the pipe of the well, to the interlock system 30 located downhole, even when the system 30 is mobile and in motion. The pulses may be generated at the surface and correspondingly received at the system 30 downhole in a particular series or pattern of strikes and pauses to provide coded information. For example, a certain pattern of pulses and non-pulses may indicate the start or stop of a message. The message itself may also be a series or pattern of pulses and non-pulses, and may include any information, such as information that can be used to determine location of the system 30. The system 30 may be pre-programmed with decoding instructions or a list of possible codes that may be received, so it can interpret the message from the series or patterns of pulses received.

For instance, in one example a sensor 32 first receives a "start" code in pulses, followed by a message code and then a "stop" code. The message may include the time that pulse or message was generated at the surface. Accordingly, the message may include a time stamp for use in location or depth determination. The system 30 may include a clock or timer that is synchronized with a clock or timer at the surface. The sensor 32 receives the pulses providing the message, and records the time the message is received. A processor then decodes the message, revealing the time the corresponding message code was generated at the surface. This processor can be part of the sensor 32 or may be the processor 34 of the interlock system 30. The processor compares the decoded message, the "generation time," to the time the pulses forming the message were received at the system 30. The difference between these two times indicates the distance or time it took the message pulses to travel through the well media. This number is divided by the travel time of the particular type of pulse through mud or pipe material, such as the speed of sound through steel, which is a known constant. The result is the location of the system 30 as distance from the surface.

For example, a series of three short sound pulses received within two microseconds of each other may indicate "start." A further series of pulses and pauses of various durations may encode a message of "this message was generated at 10.456 seconds." The sensor 32 receives the message at time 11.213 seconds. A processor compares 11.213-10.456, yielding 0.757 seconds. In this example, the pulses are sound waves, and the casing of the wellbore is made of steel. Sound waves travel through steel at a rate of 57.1 ft/sec. Dividing 0.757 seconds by 57.1 ft/sec yields 13,257 feet as the distance the sensor 32 was located from the distance when it received the message.

Since the system 30 only uses time received and time messages to determine location, this determination is independent of the velocity of the system 30 or the equipment 20 on which it is carried. Additional messages may be sent to provide additional information for increased accuracy in determining the depth of sensor 32 and distance determination. Further, once multiple messages are received by a sensor 32, the speed of the sensor 32 can also be determined. Error can be reduced by additional messages, which can be particularly useful when the interlock system 30 is in motion while receiving the messages. Error can also be reduced by repeatedly calculating speed and comparing to a single point reference, such as may be provided by another sensor 32.

In still other examples, the pulses may be generated at the surface at a constant, uniform rate. The sensor 32 receives the pulses as it moves through the well and records the time. The system 30 may be programmed with the rate of pulse generation and Doppler shift information, which may be applied to the times the various pulses are received by the sensor 32 to determine the distance from the surface, and therefore, location.

In some embodiments, at least one sensor 32 may be a mechanical sensor that uses mechanical properties such as distance to determine the absolute or relative location of the interlock system 30. For example, the mechanical sensor may be a distance measuring wheel attached to an exterior surface of the locatable equipment 20. The locatable equipment 20 is positioned in the wellbore so the wheel contacts the casing 7. As the locatable equipment 20 moves along the wellbore, the wheel rotates as it moves along the casing 7. Since the diameter and circumference of the wheel are known, the distance measuring wheel can determine the distance traveled based on the number of revolutions of the wheel. This type of sensor therefore can be used to determine the relative location of the interlock system 30. However, obstacles traversed by the wheel or bumps causing the wheel to lose contact with the casing 7 may insert some degree of ambiguity into the distance determination.

The mechanical sensor may also be a digital distance tracker that uses acceleration or speed to calculate the distance traveled. The distance may be tracked or reported electronically, though measuring a mechanical property. The mechanical sensor may also be a pulse sensor, such as a wave or pressure sensor, that can detect pulses and pulsed messages from the surface and decode the messages to determine distance from the surface or speed, as described above. Other mechanical properties including speed, temperature, pressure, and spatial orientations can be monitored or measured with a mechanical sensor. For instance, an accelerometer may be used to determine the speed at which the interlock system 30 is moving, and may monitor continuously to adjust the speed determinations continuously as the interlock system 30 moves. A combination of the speed and time spent in motion can be used to determine the distance traveled, and therefore the relative location of the device 30. The mechanical sensor may also be a thermometer, either digital, alcohol or mercury based, that measures the temperature of the surrounding environment. As the device 30 travels further underground, the temperature will drop. The temperature of the entire well may be mapped before deploying the device 30, and when a certain temperature is reached, the relative location of the device 30 may be determined by comparison to known temperatures at various depths. Similarly, the mechanical sensor may also be a pressure sensor, such as silicone on sapphire or any other transducer the measures changes in wellbore pressure from 0 to 30,000 psi. The further underground the interlock system 30 travels, the more the pressure may increase. As with temperature, the pressure gradient along the well may be mapped beforehand, and readings from the pressure sensor can be compared to this gradient to determine the location of the device 30 or locatable equipment 20.

The mechanical sensor may also be a gyroscope or other similar device that detects spatial orientation. For instance, it may be preferable to activate the locatable equipment 20, such as a perforating gun 21, only once the heel of the well has been turned and the wellbore is substantially horizontal rather than vertical. A gyroscope, particularly a three-axes variety, may be used to indicate when the equipment 20 changes from an upright to horizontal position, indicating it is now in the horizontal part of the wellbore. The spatial sensor need not be a gyroscope, but may be a mercury switch, ball and funnel, inertial measurement unit (IMU), three-axis accelerometer, Hall effect sensor or geomagnetic sensor in other embodiments where each device can detect and count each time the sensor 32 crosses over a threshold, such as by more than a five-degree change over the current orientation. For example, in one embodiment the threshold may be set to 90 degrees, and when the spatial sensor detects a change in either direction of more than five degrees, say to 96 degrees or 84 degrees, the spatial sensor may register a detection event 17. The degree of change in the spatial orientation, such as between vertical and horizontal, corresponds to various known locations within the wellbore. The spatial sensor may therefore be used to verify the relative or absolute spatial orientation and navigation of the interlock system 30 within the wellbore. In some embodiments, turbulence in the flow of wellbore fluid may be induced by the strategic inclusion of ribs, fins, baffles or other similar structure protruding into the interior of the wellbore to disrupt the flow of wellbore fluid. Since these turbulence-producing structures are included at predetermined locations of known depths, when a spatial sensor such as a gyroscope conveys changes in orientation exceeding the threshold in rapid succession indicates the interlock system 30 is at the turbulence-inducing structure, and the absolute location of the device 30 is determined. In still other embodiments, the mechanical sensor may be an arm or spring that comes into contact with the wellbore and detects each node or collar based on the change in diameter or where the pin faces or shoulder of each joint make up inside of each collar, such as by deflection when encountering the connection of the node or collar.

Any of the above types of sensors 32 may be used in the interlock system 30 described herein. Various different sensors 32 may be of the same type, such as measuring or detecting the same type of property or physical condition, and may do so by the same or different mechanism. In other embodiments, at least two of the sensors 32 are configured to detect different properties or physical conditions. In some embodiments, at least three different types of properties or physical conditions may be detected by different sensors 32.

Regardless of the property or physical condition they detect, the sensors 32 may be positioned at or toward the exterior of the interlock system 30 to enable transmitting and/or receiving of signals 15. They may also be configured to detect their particular properties within a preselected proximity, such as within 2-5 feet or less. Accordingly, the sensors 32 may be near-field sensors of physical, electromagnetic, magnetic, radiowave, radiative, ultrasonic, sound and other properties of the location identifier 14.

As shown in FIG. 7, each of the sensors 32 is connected to a processor 34, such as a microprocessor, having memory and being programmable with various information. For instance, the reference information for each of the various sensors 32 may be programmed into the processor 34 before deploying the device 30. The reference information defines the parameters by which any detected information is to be compared to determine absolute or relative location of the device. The reference information may be, but is not limited to, particular radio-frequencies; magnetic signatures; radiation signatures; amounts of magnetic field strength or flux; radiation levels of specific isotopes; levels of electrical properties; unique identifying authentication codes from RFID tags; PIN information or algorithms to determine the same; baselines for any detectable physical condition; thresholds for changes to physical conditions; and locations where each of the above are known to exist in the wellbore. For instance, the reference information may include that radiation levels of 45 GAPI indicates a location of 14,000 feet below the surface, or a particular magnetic signature of 45 Gauss is located at 30,000 feet, or the baseline ultrasound reflection time is 3 milliseconds and anything exceeding that threshold indicates thicker materials, and therefore a node 9, or when the number of nodes 9 counted equals 100, a depth of 3,800 feet is reached. These are but a few illustrative examples and are not intended to be limiting. The processor 34 receives electronic signals from each sensor 32 indicating a detection event has occurred, such as indicating proximity to a locational identifier 14 or a distance traveled. The processor 34 takes these electronic signals and derives location information from the signals, which may be relative or absolute location information. The processor 34 also compares the derived location information to the corresponding reference information for that sensor 32. When the derived location information matches the corresponding programmed reference information for a given sensor 32, a verified detection event is defined as having occurred at that sensor 32. Accordingly, not only is information received indicating the location of the equipment 20 or system 30, but the location is verified according to preselected parameters.

The processor 34 also includes logic circuitry that is used in connection with verified detection events. The various verified detection events act as an interlock system, where a number of verified detection events are required before a trigger signal is generated to activate a downhole event. This activation occurs through the logic circuitry of the processor 34. For instance, in at least one embodiment, each sensor 32 corresponds to a dedicated logic gate in the circuitry. The default setting for all the logic gates is 0. When a detection event from a sensor 32 has been verified as described above, the logic gate corresponding to that sensor 32 is changed from 0 to 1. As additional detection events occur and verified, additional corresponding logic gates are changed from 0 to 1. When a certain threshold number of logic gates are in the 1 position, the processor 34 generates a trigger signal and sends this trigger signal to an activation mechanism, such as an addressable switch, to activate the downhole event. The activation mechanism is connected to an activation assembly 23, such as a detonation assembly in a perforating gun or a deployment mechanism to set a plug. The activation assembly 23 may have its own local protocol or series of steps required for activation, which are triggered when the activation assembly 23 is accessed by the activation mechanism.

The processor 34 may also include a timing mechanism, such as a timer or timing circuitry, that may track absolute time. The processor 34 may also be capable of determining an activation time or time delay based on the current speed of the device 30, and setting the timer to track the activation time or time delay. Once the timer expires, the activation assembly 23 can be activated. The activation time may be on the order of microseconds, milliseconds, seconds, or even minutes, depending on the location and speed of the locational device 30 and the distance to the desired location for downhole activation. For example, the activation time may be in the range of 1 nanosecond to 1440 minutes. In some embodiments, the activation time may be in the range of 1-1000 microseconds. In other embodiments, the activation time may be 1-10 seconds. In still other embodiments, the activation time may be in the range of 15 to 150 minutes. Upon the expiration of the activation time, the interlock system 30 will have traveled a known distance, based on the speed information provided by an accelerometer for instance, and will be at the desired location for activation. Therefore, the processor 34 may calculate the activation time back from the ultimate desired location and the current speed of the system 30.

The interlock system 30 may also include a power source 35, such as but not limited to a battery, that provides power to the various components of the interlock system 30, including the processor 34 and sensors 32. Some components, such as an RFID transducer, may have its own local or dedicated power source, but the majority of the sensors 32 and processor 34 may be powered by a common power source 35.

In at least one embodiment, the components of the interlock system 30 are contained within a housing 31, as shown in FIG. 7. The interlock system 30 may therefore be self-contained and mountable to any piece of locatable equipment 20, such as but not limited to a perforating gun, plug, tool, and reservoir of material. In some embodiments, as in FIGS. 5 and 6, the interlock system 30 is mounted to the locatable equipment 20, and preferably is positioned so that the sensors 32 of the interlock system 30 are facing the casing 7 of the wellbore when deployed therein. The interlock system 30 may be mounted to any location along the locatable equipment 20, such as at the leading edge, trailing edge, centrally located, circumferentially wrapping at least a portion of the locatable equipment 20, and other arrangements. In some embodiments, the housing 31 of the interlock system 30 is integrated with the locatable equipment 20 and its housing. The various components of the interlock system 30 remain in electrical communication with one another to permit signals and information to be sent and received there between despite physical distance that may separate them. Regardless of whether mounted to, formed with, or integrated in the locatable equipment 20, the interlock system 30 may extend from the surface, be coextensive with the surface, or be recessed within the surface of the locatable equipment 20, and is electronically isolated from the surrounding environment of the wellbore, casing, well fluid, surface of the well, and any devices located at the surface of the well.

As should be evident from the above description, the interlock system 30 does not rely on a wired connection to the surface, such as a wireline or slickline. Therefore, the interlock system 30 can operate entirely independent from the surface, and requires no information sent to or instruction from the surface for activation of associated equipment 20. The information from the various sensors 32 provides for location determination and verification within a self-contained interlock system 30 that may be independent or on a mobile locatable equipment 20. Therefore, not only is relative and absolute positioning determined, but safety mechanisms are provided by the present invention to enable accurate, precise and safe activation of perforating guns, plugs, and downhole tools and equipment.

Figure 9:
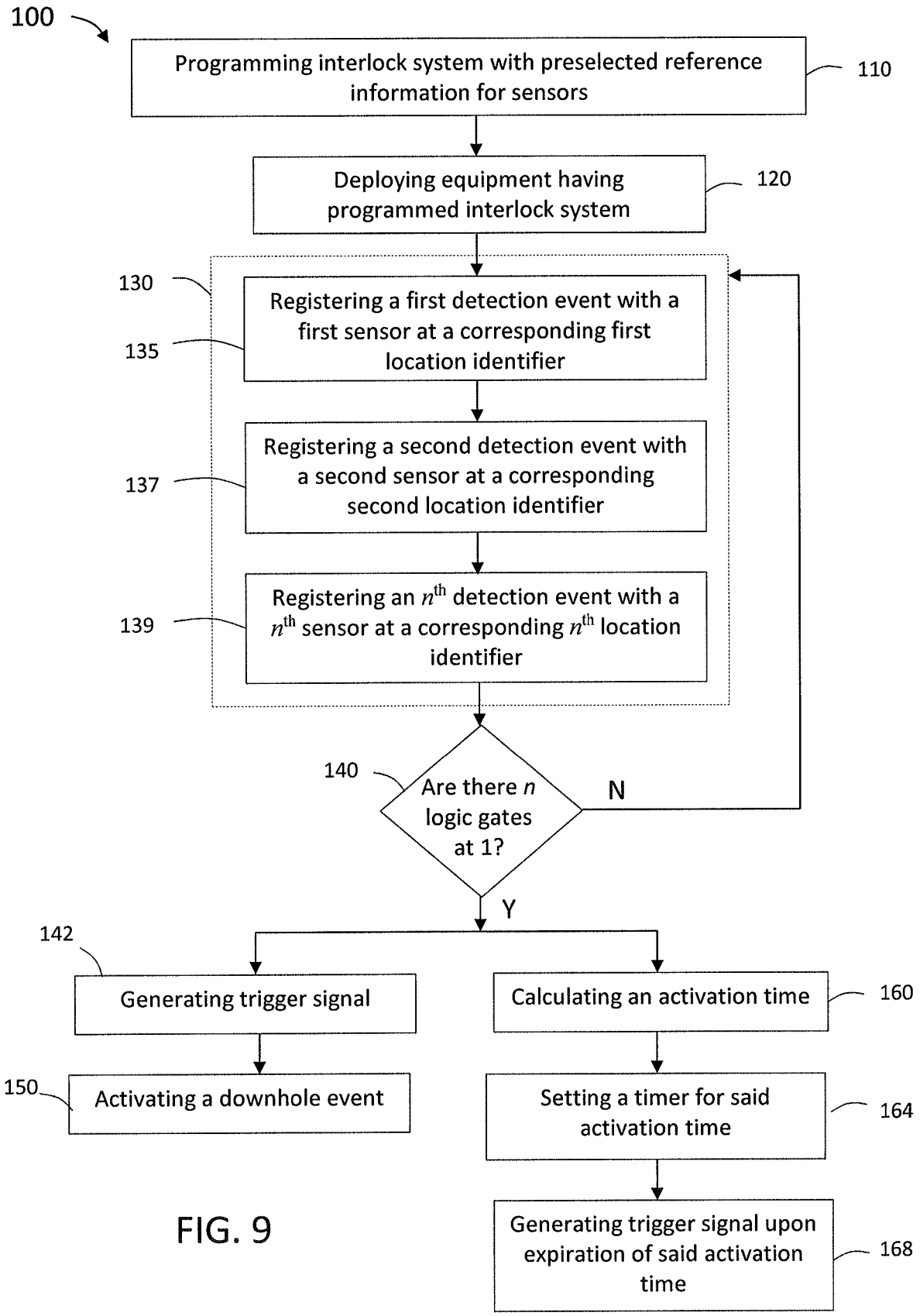
FIG. 9 is a schematic diagram of the method of automatically activating an interlock system.

The present invention also includes methods for using an interlock system as described above. Such methods are described in greater detail with reference to FIGS. 9-19B. Generally, a method of using an interlock system, as at 100, is shown in FIG. 9. The method 100 begins with programming the interlock system with preselected reference information for sensors, as at 110. The preselected reference information corresponds in number and kind with the particular sensors 32 that are present in the particular interlock system 30 being programmed. For instance, if the interlock system 30 includes an RFID sensor configured to recognize two specific and unique identifying sequences (UIDs), a magnetic sensor configured to recognize a particular magnetic signature, and an ultrasound sensor, the processor 34 of the interlock system 30 may be programmed with the reference information for each, namely, the particular UIDs for the RFID and the locations/depths where each should be located, the particular magnetic signature found at a particular depth, and the number of detection events needed to be registered by the ultrasound sensor to indicate a particular depth. Other reference information may also be programmed into the system 30 and/or processor 34 at step 110, including but not limited to the number of detection events needed to be verified before activation can occur, relevant thresholds, etc.

The method 100 also includes deploying equipment having the programmed interlock system, as at 120. In the case of a wellbore, deploying the equipment entails sending the equipment down the well. In some cases, it may be lowered on a wireline or slickline. In a preferred embodiment, however, the equipment may be released free-fall into the wellbore, or placed against the interior surface of the wellbore and allowed to fall or roll along the surface of the wellbore. Therefore, the interlock system 30 and locatable equipment 20 may be wireless from the surface.

Figure 10:
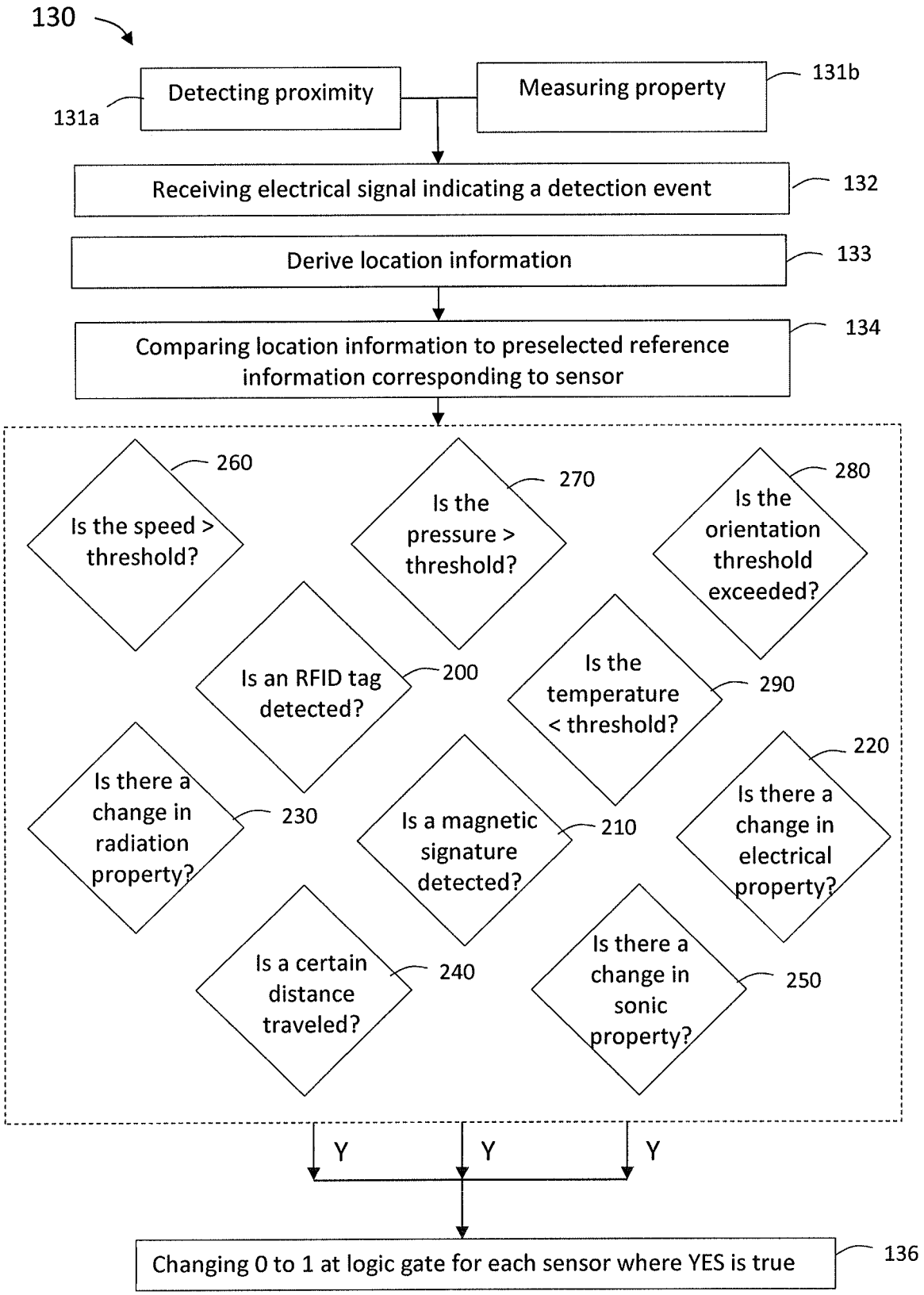
FIG. 10 is a schematic diagram of a method of registering a detection event.

The method 100 also includes registering detection events with sensors, as at 130. Each sensor 32 is configured to detect a particular physical condition, such as when in sufficient proximity to the corresponding location identifier 14. With reference to FIG. 10, when proximity to the corresponding location identifier 14 is detected, as at 131*a*, or property is measured, as at 131*b*, the sensor 32 sends an electrical signal to the processor 34 of the interlock system 30. The processor 34 receives the electrical signal from each sensor, as at 132, and derives location information for the corresponding sensor from the electrical signal, as at 133. The processor then compares the derived reference information to the programmed reference information corresponding to that sensor 32. If they match, the processor 34 verifies a detection event. In this way, a detection event is registered and verified. Detection events are registered for each sensor 32 in the interlock system 30. For instance, the method may include registering a first detection event with a first sensor at a corresponding first location identifier, as at 135 in FIG. 9, registering a second detection event with a second sensor at a corresponding second location identifier, as at 137, registering an $n^{th}$ detection event with an $n^{th}$ sensor at a corresponding $n^{th}$ location identifier, as at 139, and so on for as many different sensors 32 as there are in the system 30.

When a sufficient number n of verified detection events have been registered and verified, as also may be programmed at the beginning of the process, the processor 34 generates a trigger signal, as at 142. This trigger signal may be sent to the activation assembly 23, activating a downhole event, as at 150. For example, in some embodiments, once a detection event or location information is verified, the logic gate corresponding to the particular sensor 32 is changed from 0 to 1. The processor 34 may determine if there are n number logic gates at the 1 position, as at 140 in FIG. 9. If there are, then a trigger signal is generated. In at least one embodiment, n=2 or more, and in a preferred embodiment, n=3. In some embodiments, activation may occur automatically once n number of logic gates are at 1, as at 142. In other embodiments, activation first involves calculating an activation time, as at 160. The activation time is the time required to reach the desired location for activation, and is based on the velocity or speed of the interlock system 30, as discussed above. Once the activation time is determined, a timer is set for the activation time, as at 164. Once the timer expires, the trigger signal to activate a downhole event is generated, as at 168.

Registering a detection event, as at 130 and shown in FIG. 10, occurs for each sensor and each detection event. For illustrative purposes, it will be explained with reference to only one sensor for simplification. However, it should be understood that this process occurs each time a sensor detects or measures a corresponding property or change thereto. In one embodiment, registering a detection event, as at 130, may include checking to see if the device is moving. Movement may be beneficial to prevent inadvertent activation when the device 30 is not moving in a well. Accordingly, even if RF frequencies are detected by an RFID sensor, some embodiments may require movement before the RF frequency will be considered for a detection event. This is one potential safety feature. Not all events or embodiments of the method require movement of the interlock system 30 before monitoring for a detection event, however.

As shown in FIG. 10, the interlock system 30 may be configured to detect various different properties or physical conditions, such as but not limited to, radio-frequency (RF), magnetic field, electrical property, radiation, distance, sound, speed, pressure, spatial orientation, and temperature. Registering a detection event for radio-frequency may include asking if there is an RFID tag detected, as at 200. Registering a detection event for a magnetic field may include asking if a magnetic signature is detected, as at 210. Registering a detection event for an electrical property may include asking if there is a change in electrical property detected, as at 220. Registering a detection event for radiation may include asking if there is a change in radiation property, as at 230. Registering a detection event for distance may include asking if the distance traveled meets a certain distance, as at 240. Registering a detection event for sound may include asking if there is a change in sonic property, as at 250. Registering a detection event for speed may include asking if the speed detected exceeds a preselected threshold speed, as at 260. Registering a detection event for pressure may include asking if the pressure exceeds a preselected pressure threshold, as at 270. Registering a detection event for spatial orientation may include asking if the device orientation threshold is exceeded, as at 280. Registering a detection event for temperature may include asking if the temperature detected is above, below, or equal to a preselected temperature threshold. Particular ways for registering each of these types of events will now be discussed.

Figure 11:
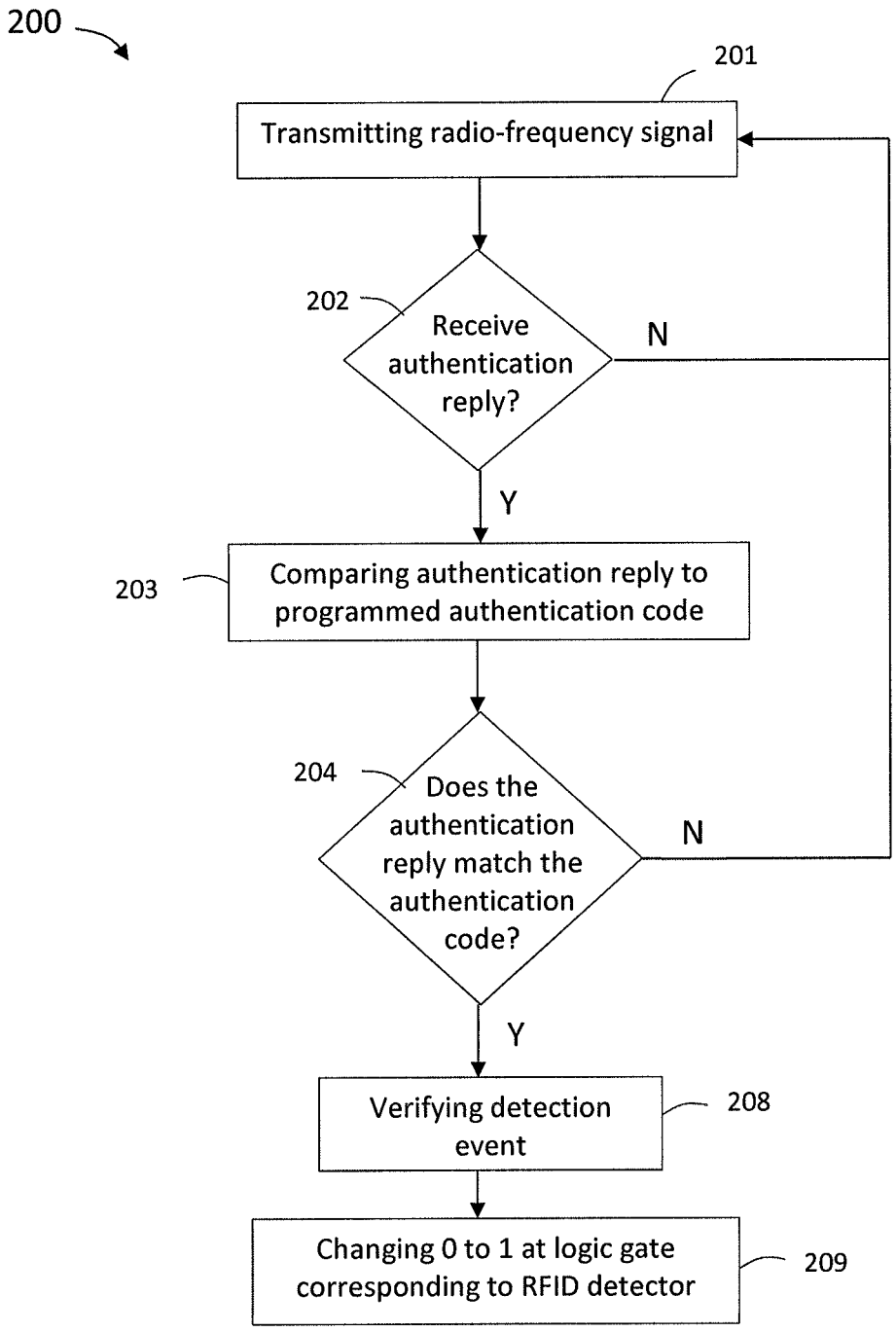
FIG. 11 is a schematic diagram of a method of detecting radio-frequency.

With reference to FIG. 11, the method of determining if an RFID tag is detected, as at 200, may include transmitting radiofrequency signals, as at 201. These transmitted signals may be the signals 15*a* discussed earlier. This step is included when the RFID sensor, such as an RFID reader, is actively sending and receiving RF signals, such as an interrogator searching for a tag to respond. In some embodiments, however, the step of transmitting radiofrequency signals is not necessary, such as when the RFID sensor is a passive tag. The method 200 further includes receiving an authentication reply, as at 202. The authentication reply may be the return signals 15*b* discussed earlier. When the RFID is passive, the authentication reply is simply an incoming RF signal. If no authentication reply is received, the RFID sensor continues searching, monitoring or polling for radio-frequency signal, as at 201. Once an RF signal is detected, the method 200 includes comparing the authentication reply to the programmed authentication code, as at 203. This may be performed by the processor of the RFID sensor itself, or the authentication reply may be transmitted to the processor 34 of the interlock system 30 which performs the comparison. Accordingly, the authentication code may be one of the preselected reference information with which the processor 34 is programmed. If the authentication reply matches the programmed authentication code, as at 204, then the method 200 proceeds with verifying the detection event, as at 208. This may include sending a signal to the logic circuitry of the processor 34 to turn the logic gate corresponding to that particular RFID sensor from 0 to 1, as at 209. Other methods of logic circuitry are also contemplated herein. This registers an RF detection event as verified. If the authentication reply does not match the programmed authentication code, then this was an errant RF signal detected that does not register as a detection event, and the RFID sensor continues searching, monitoring or polling for radio-frequency signal, as at 201.

Figure 12A:
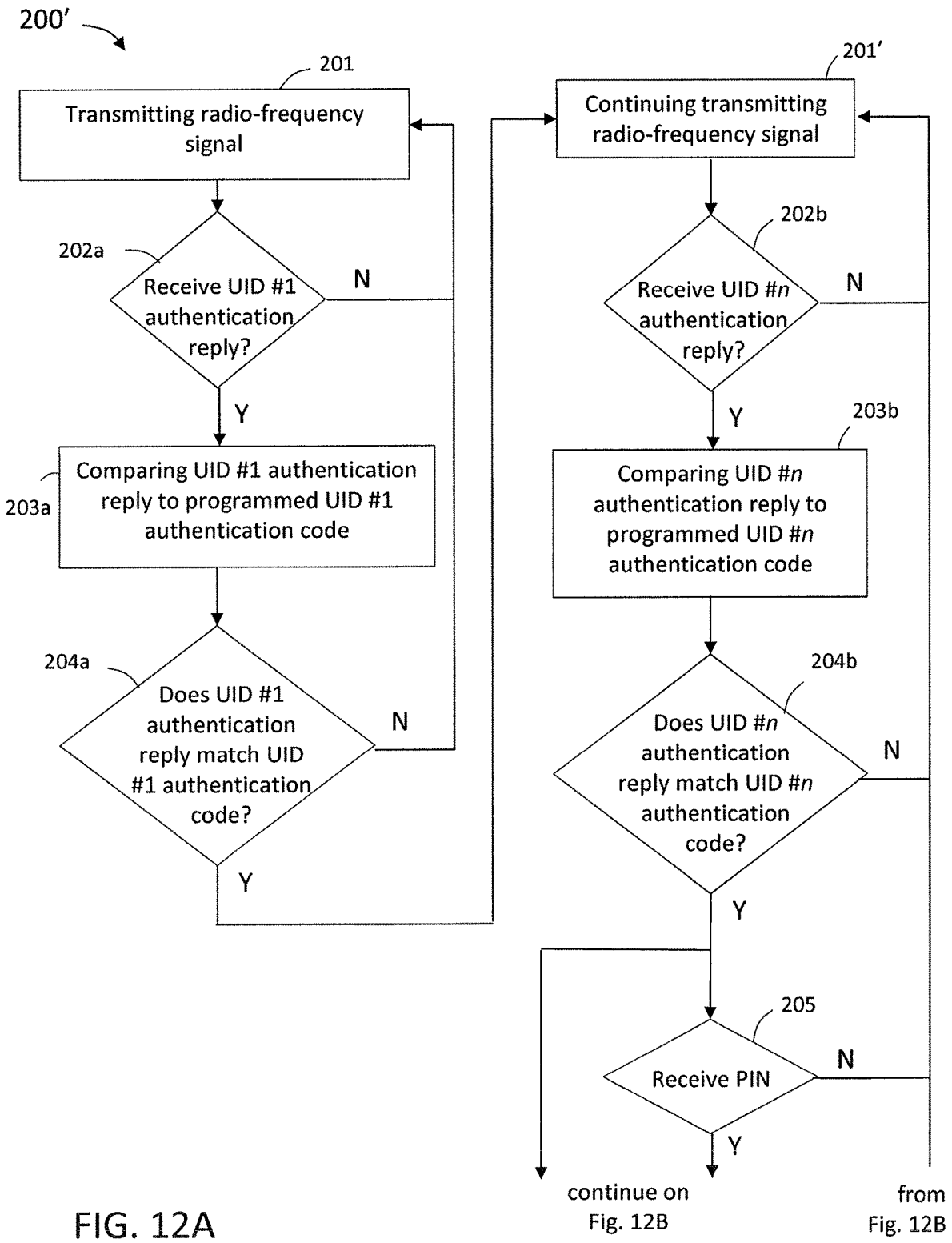
FIGS. 12A and 12B collectively show a schematic diagram of another method of detecting radio-frequency.
Figure 12B:
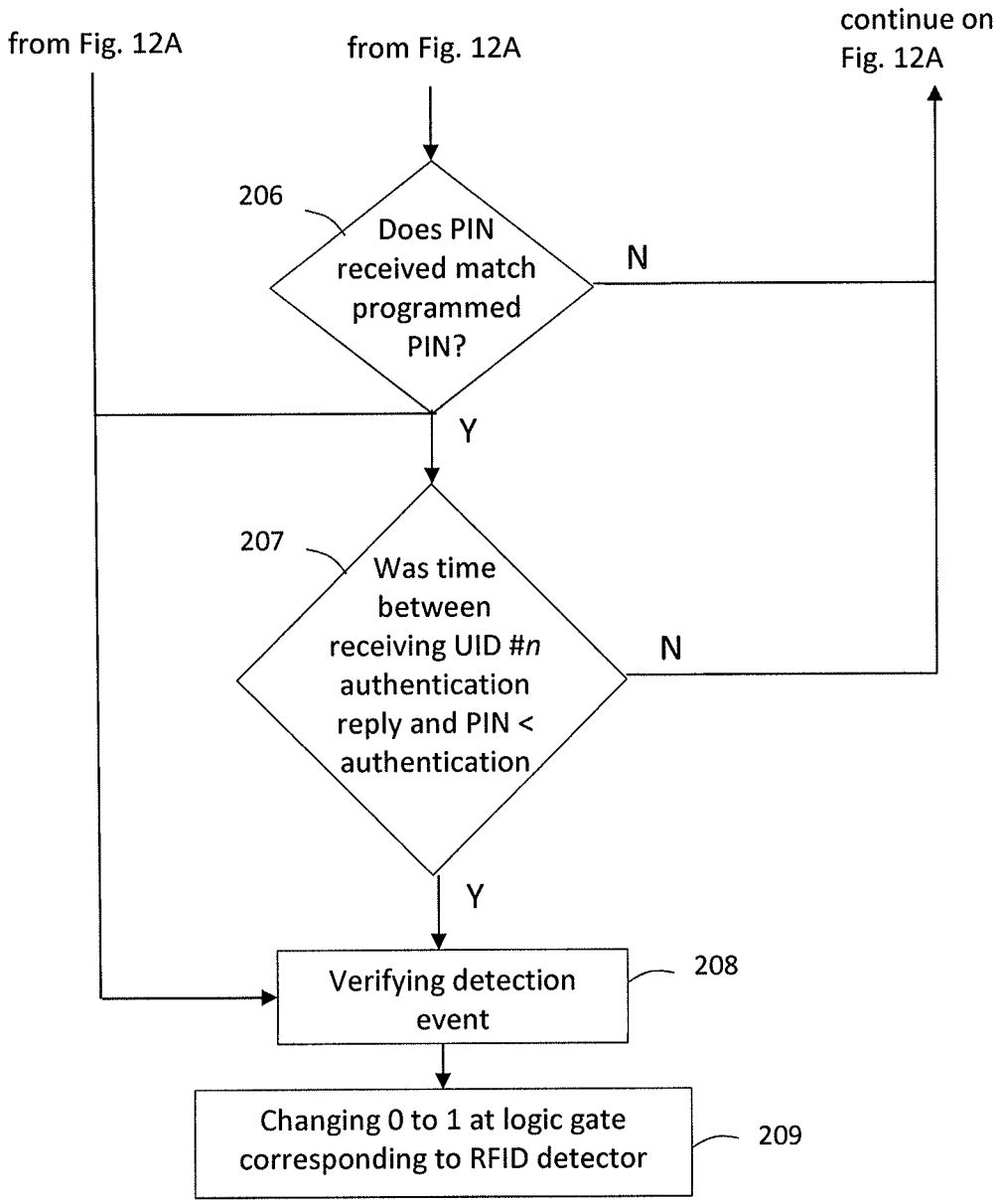

In other embodiments, such as depicted in FIGS. 12A-12B, multiple unique identifying codes (UID) such as described previously must be received and validated before a detection event can occur. A single RFID sensor may be configured to receive the various UIDs, or multiple different RFID sensors may be present, each configured to receive a different UID. Different location identifiers 14 will have different UID codes programmed or associated therewith, and will preferably be placed at different known locations within the wellbore. The method of detecting RF signal, as at 200', may include transmitting radio-frequency signal, as at 201. This is an optional step, as in the other RFID detection method. The method of detecting RF signal, as at 200', includes receiving a UID #1 authentication reply, as at 202*a*. This is a first UID, and is received by the RFID sensor. It may be the response from an active RFID tag, or it may be a passively received signal from the RFID reader interrogation. The method 200' continues with comparing the UID #1 authentication reply to a programmed UID #1 authentication code, as at 203*a*. If there is a match, as at 204*a*, then the method 200' continues with continuing with transmitting radio-frequency signal, as at 201'. If there is not a match, then the method 200' continues transmitting radio-frequency signal, as at 201. The method 200' further includes receiving subsequent UID authentication replies, up to UID # n authentication reply, as at 202*b*, where n indicates the number of UID authentication replies received. Accordingly, any number of UID tags may be used throughout the well. UID authentication replies subsequent to UID #1 can be received by the same RFID sensor or a different RFID sensor as UID #1, depending on the configuration and programming of the RFID reader. Each UID # n authentication reply is distinct and different from the UID #1, and the location identifiers 14 carrying each are at different locations or positions within the wellbore. The UID # n authentication reply is compared to the programmed UID # n authentication code, as at 203*b*. If they match, as at 204*b*, then the method 200' continues. If they do not match, then the method returns to transmitting radio-frequency signals, as at 201'.

In some embodiments, the method 200' further includes receiving a PIN, as at 205. The PIN may be a multi-digit or multi-numeral code as previously described that must also be received as a further confirmation and verification step. If the PIN is received, then the PIN is compared to a programmed PIN. If they match, as at 206, then the detection event may be verified, as at 208, to change the logic gate for the RFID sensor from a 0 to 1, as at 209. In other embodiments, once the PIN received is confirmed to match the programmed PIN, a time component may also be considered in the verification process as yet another level of protection. For instance, the time between receiving the UID # n and receiving the PIN may determined. If the time from receiving the UID # n and receiving the PIN was less than a preselected authentication time, as at 207, then the detection event is verified. The preselected authentication time may be any length of time, such as nanoseconds, microseconds, or milliseconds, to prevent false positives from attempts at duplication through computation. The detection event may therefore be verified, as at 208, to change the logic gate for the RFID sensor from a 0 to 1, as at 209. In other embodiments, receiving a PIN is not required, and verification of a detection event occurs once the UID # n is confirmed a match with the programmed UID # n. Accordingly, the safety interlock may require a number of UIDs to be verified before a single detection event may be verified. In other embodiments, as described above in connection with FIG. 11, each UID may be verified and considered a separate detection event, though multiple UIDs may be detected.

Figure 13:
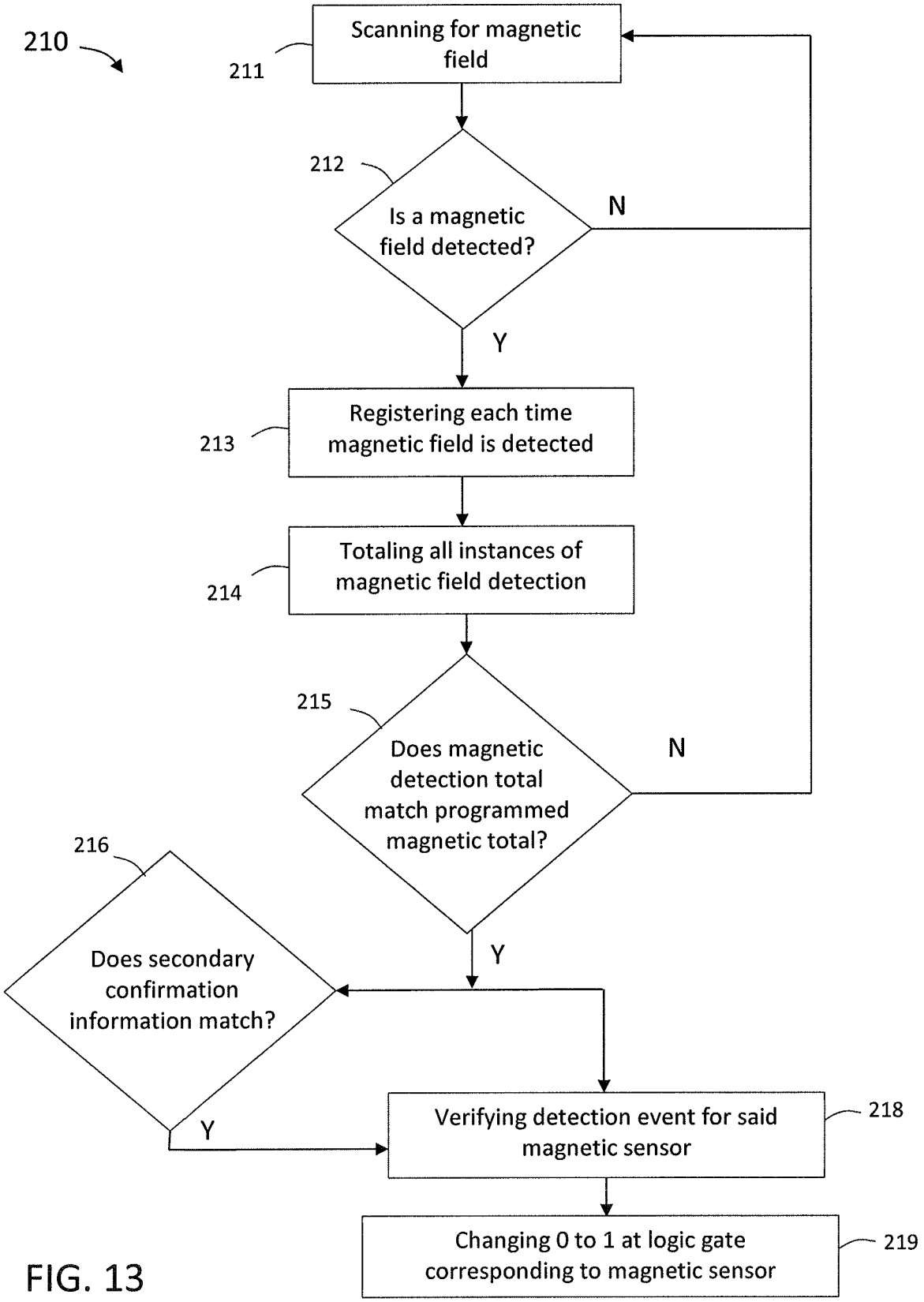
FIG. 13 is a schematic diagram of a method of detecting a magnetic property.

There are some methods of detection that can be used to detect different types of properties. For example, FIG. 13 shows a method of detecting a property by tracking the number of times the property is detected and comparing to total number of times that property should have been detected. This may be referred to herein as the "tracking method." Magnetic, radiation, electrical, and mechanical properties may be detected by a tracking method. FIG. 13 shows one example of the tracking method as applied to detecting magnetic fields, such as with a Hall effect sensor. Other tracking examples include observing the total number of instances where the gamma ray exceeds a threshold level such as 100 or 250 GAPI, the number of nodes or collars found by sound interrogation or mechanical properties, or the quantity of instances that the electrical resistance changed due to node connections, for instance.

The method of detecting a magnetic field, as at 210 of FIG. 13, may include scanning for a magnetic field, as at 211. Scanning may be active or passive. If a magnetic field is detected, as at 212, then one embodiment of the method includes registering each time or occurrence a magnetic field is detected, as at 213. For example, each time a Hall effect sensor elicits an electrical impulse upon detection of a magnetic field would be considered an occurrence detected. The number of instances of magnetic detection are totaled, as at 214, which preferably occurs as the interlock system 30 continues along its path through the wellbore. When the magnetic detection total matches a programmed magnetic total, as at 215, magnetic detection may be verified for that sensor, as at 218, and the corresponding logic gate changed from 0 to 1. Accordingly, the magnetic detection total may be included in preselected reference information. In some embodiments, however, additional secondary confirmation information must also be compared and match, as at 216, before a magnetic detection event will be verified. Such secondary information may include any additional information that can provide a second level of protection, such as the actual quantity of Gauss at the final or last measure point. If the magnetic detection total does not match the programmed magnetic detection total, as at 215, then scanning for magnetic field continues, as at 211.

Figure 14A:
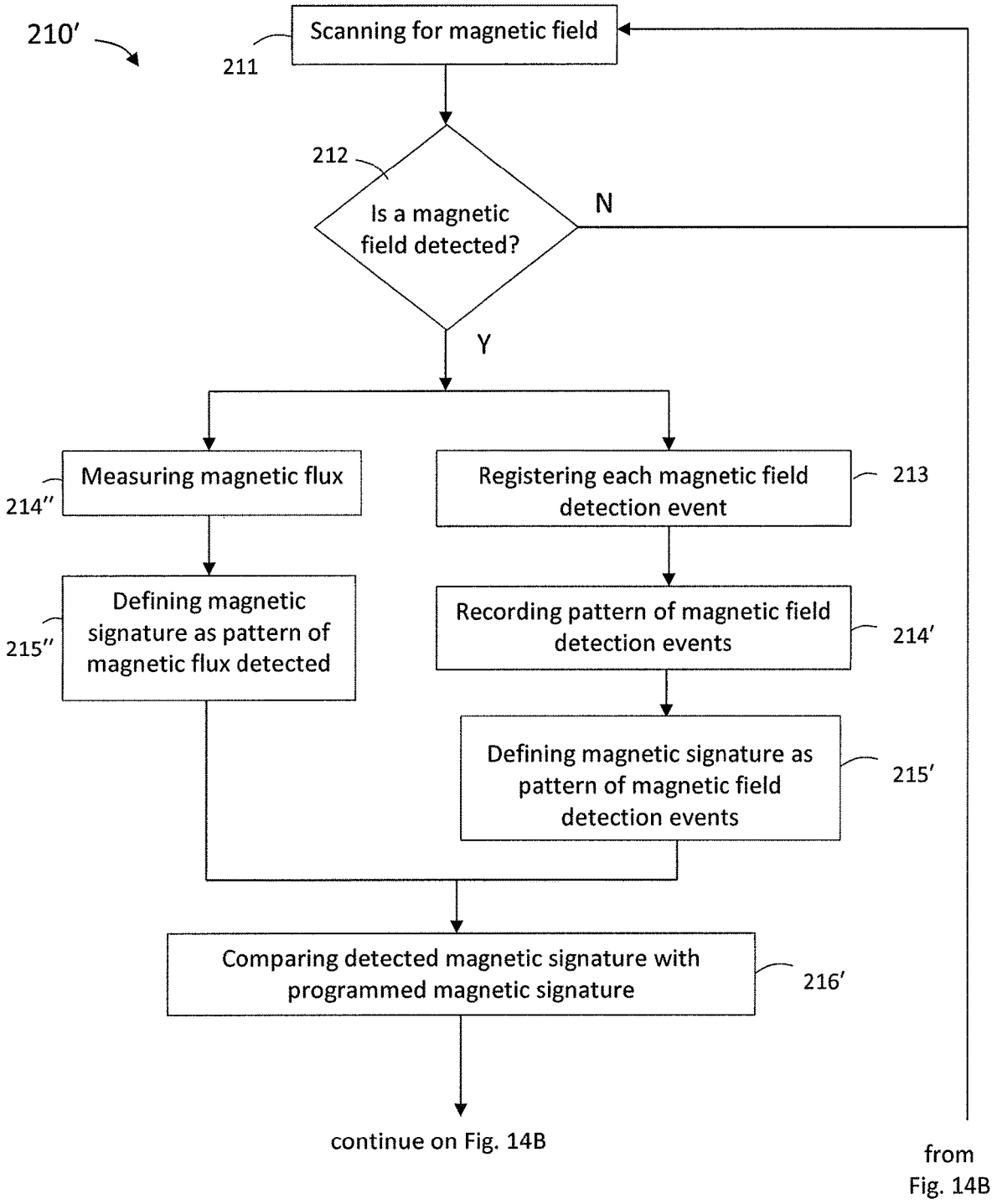
FIGS. 14A and 14B collectively show a schematic diagram of another method of detecting a magnetic property.
Figure 14B:
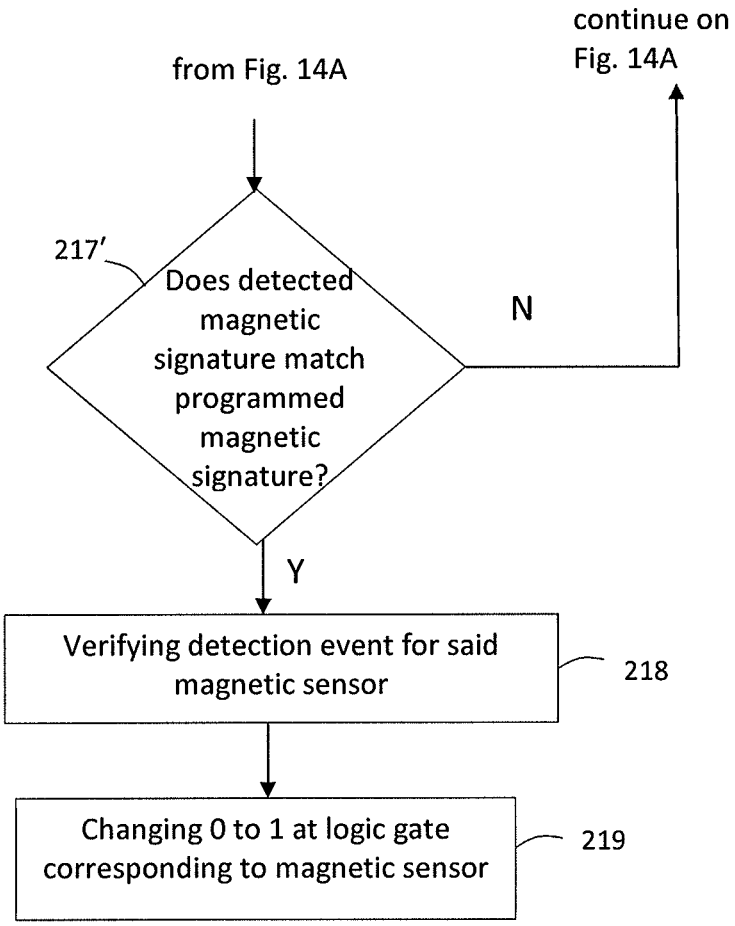

FIGS. 14A and 14B show one example of methods of detecting a property signature. The property being detected may have a particular signature, such as a magnetic signature, that is unique to it, or occurs only at one location along the wellbore. The "signature method" of detection may therefore be used to poll for this particular signature. In some embodiments, the signature may be defined as a pattern of occurrences, which may be represented as binary numbers 0 and 1. The signature method may therefore include determining the recording the pattern of 0 and 1 and determining the signature from this pattern. The magnetic signature is not limited to binary sequences, but can be any identifying sequence, such as magnetic fluxes of particular magnitudes in a particular order. In each case, the signature once determined is compared to a reference signature that has been programmed. Only if there is a match to the programmed signature will the event be verified. Examples where the signature method may be used to detect a particular property includes radio-frequency, magnetic, and radiation properties.

With particular reference to FIGS. 14A and 14B, a method of detecting a magnetic signature, as at 210', is shown. The method 210' may begin by scanning for a magnetic field, as at 211, which may be active or passive scanning. If a magnetic field is detected, as at 212, one embodiment of the method 210' includes registering each magnetic field detection event, as at 213, such as recording the pattern of 1's and 0's detected, as at 214', and defining the magnetic signature as the pattern of 1's and 0's detected, as at 215'. Another embodiment of the method 210' includes measuring the magnetic flux or strength, as at 214", and defining the magnetic signature as the pattern of magnetic flux or strength, as at 215". Regardless of how the magnetic signature is defined upon detection, it is compared to the programmed magnetic signature, as at 216'. If the detected signature matches the programmed signature, as at 217', then the detection of the magnetic signature is verified or registered for the magnetic sensor, as at 218, and the corresponding logic gate is changed from 0 to 1, as at 219. If the magnetic signature detected does not match the programmed signature, then the sensor continues scanning for magnetic field, as at 211.

Some properties require establishing a baseline in connection with monitoring and detecting. Detection of the property may occur when the property is noticed by the sensor at all, or if there is a change in the property deviating from a baseline. In some embodiments, any detectable or measurable change is sufficient register as a detection event. In other embodiments, if the deviation exceeds a preselected threshold for that property, then a detection event may be registered. This type of detection method may be referred to as the "threshold method" and may be used to detect electrical, sound, temperature and pressure properties.

Figure 15:
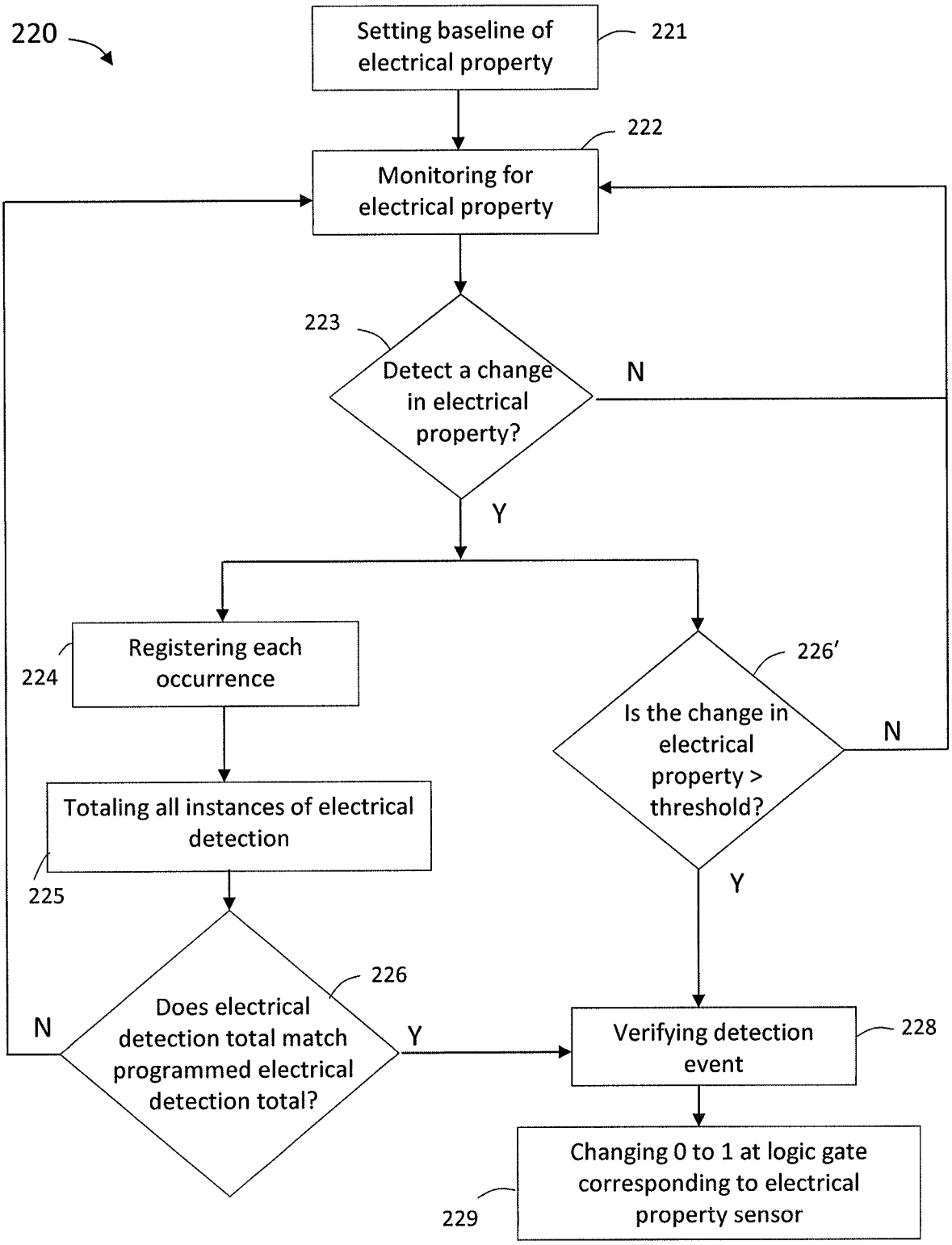
FIG. 15 is a schematic diagram of a method of detecting an electrical property.

FIG. 15 shows one example of a baseline or threshold method of detection, as well as a tracking method, both for detecting an electrical property. Such electrical property may be conductance, impedance, inductance or resistance. In the method 220, a baseline electrical property is set, as at 221. The sensor then monitors for electrical property, as at 222. If a change in electrical property relative to the established baseline occurs, as at 223, a tracking method may be used in which each occurrence of change in electrical property is registered, as at 224. All instances of electrical detection are totaled, as at 225, and the electrical detection total is compared to a programmed electrical detection total. If they match, as at 226, then detection is verified, as at 228, and a signal is sent to change the corresponding logic gate for the electrical sensor from 0 to 1, as at 229.

In the threshold method, once a change in electrical property is detected, as at 223, the change of electrical property is compared to a preselected electrical threshold. The change in electrical property is therefore not only detected but quantified as well. The amount or quantity of the change detected is compared to a threshold amount. If the change exceeds the threshold amount, as at 226', then the electrical detection is verified, as at 228, and the logic gate is changed to 1, as at 229. As noted previously, the threshold for a particular physical condition, such as electrical property, may be set at any suitable level and for any level of sensitivity, and can be as low as any detectable change. For example, in some embodiments if measuring the resistance of a casing section directly or via induced current over a length of tool would equal between 1.611 to $7.496\times10^{-7}$ Ωm for common metals. An increase in resistance of $1\times10^{-2}$ Ωm or more would indicate the presence of a collar or other material. This is but one non-limiting example.

The threshold method may also be used for detecting pressure, as at 270 (not shown). Pressures in a well are governed by the hydrostatic head in conjunction with well pressures and induced or reduced surface pressure. In a common wellbore pressures typically range from 0 psi to 25,000 psi or more. When pressure is held constant at surface (and assuming the well is kept in a static condition with no gas in the wellbore, which occurs most of the time), the incremental changes in pressure downhole can be attributed to the tool going through hydrostatic head changes associated with the trajectory of the wellbore. This trajectory can be compared to the map or utilized as a threshold for a certain depth. As the tool lowers into the wellbore the pressure increases and by knowing the surface pressure and the density of the fluid the total depth can be calculated by density×height×gravity (ro*g*h). Therefore, measurable changes in the well pressure may be recognized as a detection event.

The threshold method may also be used for detecting temperature, as at 290 (not shown), and correlate the temperature with location. The temperature of a wellbore is known to increase 1.0 degrees Fahrenheit (F) per 100 feet of vertical depth. This fluctuates per region by ±0.6 degrees based on geography and crust thickness. The well temperature can be found by taking the average surface temperature, generally close to 70 degrees F. and adding 1.6 degrees F. per 100 feet of vertical depth. Wellbore temperatures typically range from 50 degrees F. to 500 degrees F. Once the tool temperature reaches 200 degrees F., as an example, with an average surface temperature of 70 degrees F. in an area with 1.6 degrees F. per 100 feet as the gradient, one could predict the tool to be crossing through 8125 feet.

Figure 16:
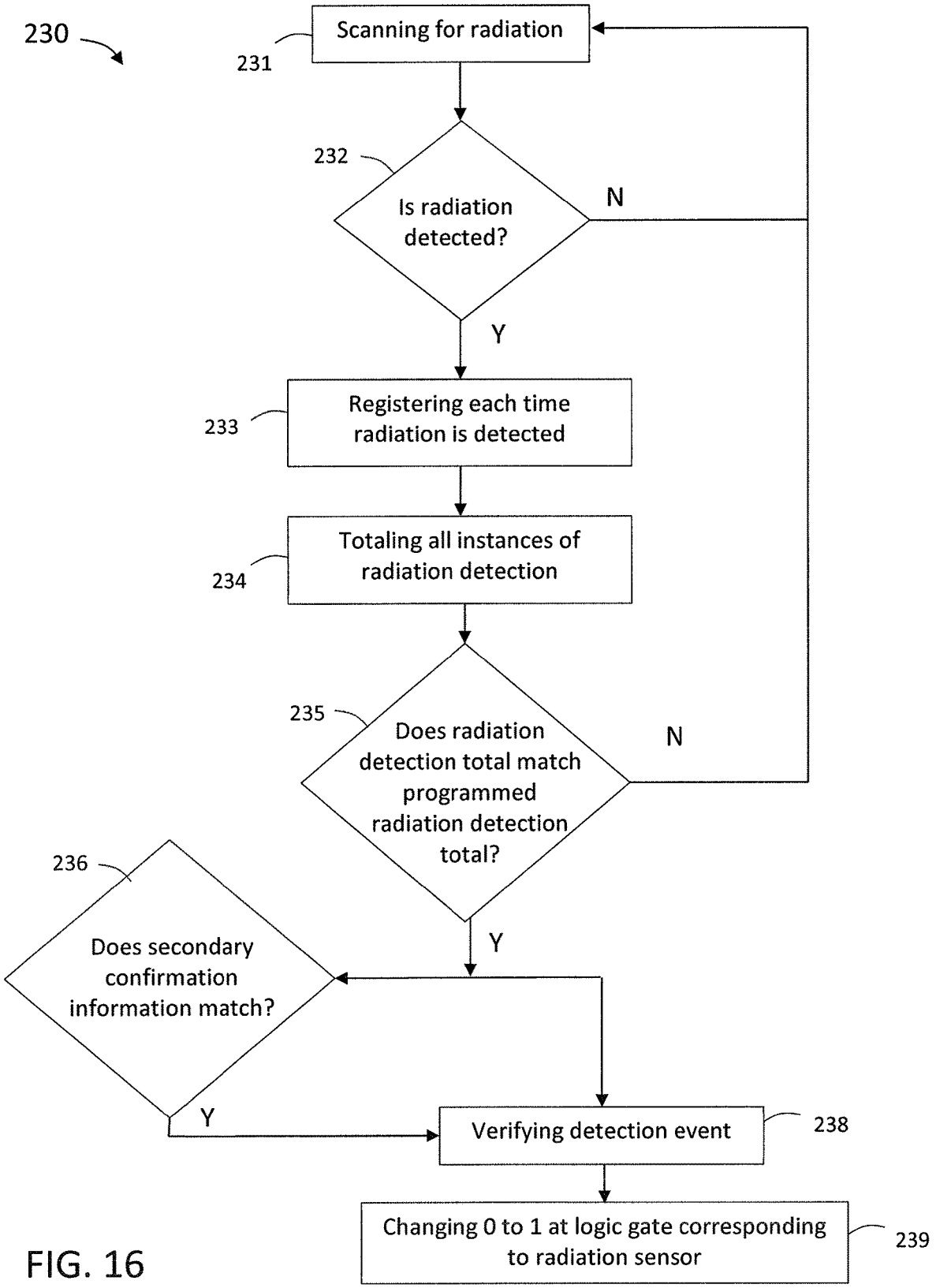
FIG. 16 is a schematic diagram of a method of detecting radiation.

FIG. 16 depicts one embodiment of a method for detecting radiation, as at 230. This method uses the counting method described above. Here, the method 230 may include scanning for radiation, as at 231. This may be passive, but in at least one embodiment is active, such as with interrogation or polling from a Geiger counter or like device used as the radiation sensor. If radiation is detected, as at 232, then each instance of radiation being detected is registered as one event, as at 233. The total number of radiation events is determined, as at 234. If the radiation detection total matches a programmed radiation detection total, as at 235, then radiation detection is verified, as at 238, and a signal sent to change the logic gate for the radiation sensor from a 0 to 1, as at 239. In some embodiments, secondary information is required to confirm the radiation detection total match, as at 236. This additional information may include the quantity of uranium, thorium, or potassium found, the ratios of such elements, or the order in which such quantities of each element are received. If such secondary information is provided, then radiation detection is verified. If the secondary information does not confirm the match, or if the radiation detection total does not itself match the programmed radiation detection total, then an insufficient number of radiation events have been detected and the sensor continues scanning for further radiation events.

Figure 17A:
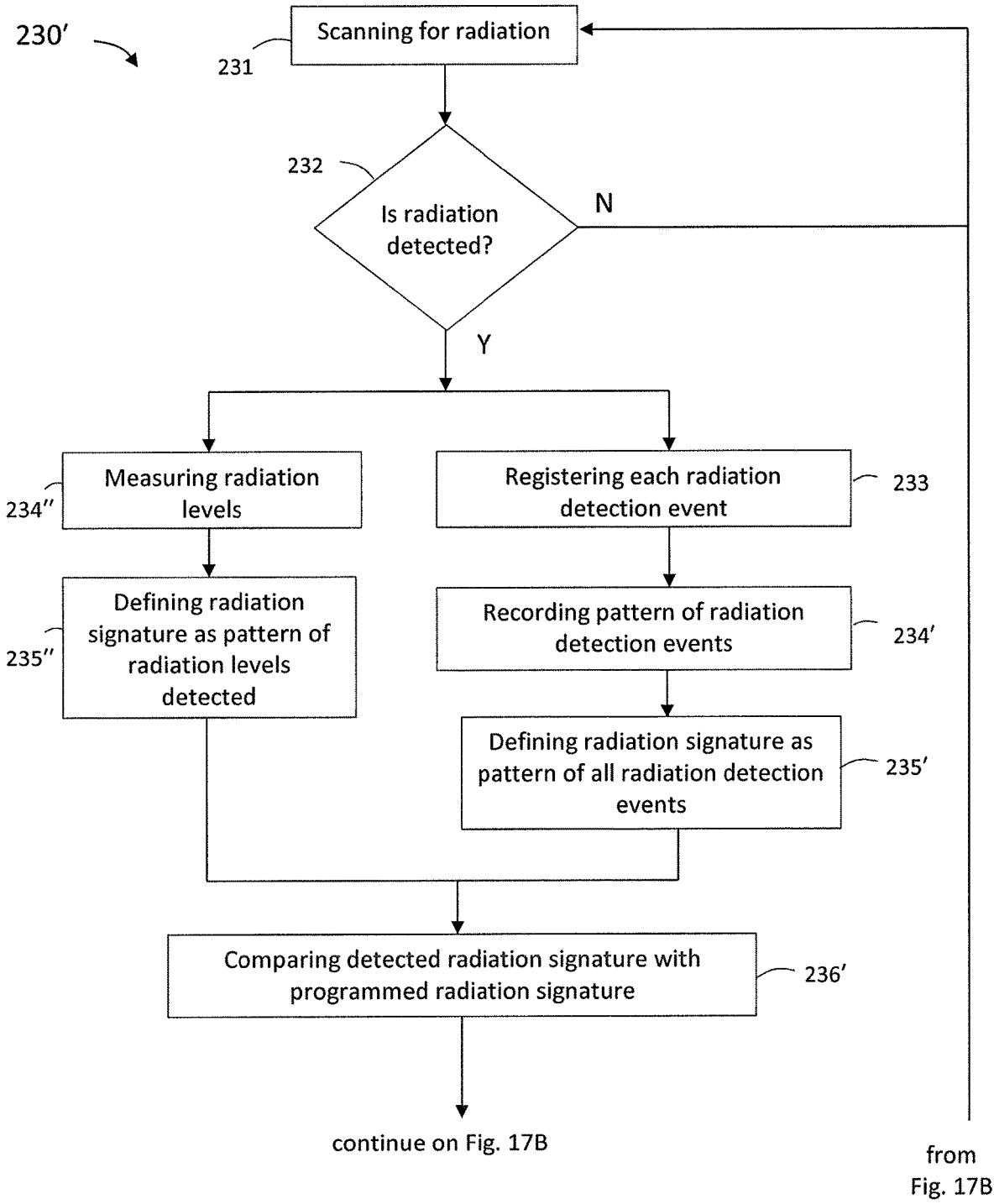
FIGS. 17A and 17B collectively show a schematic diagram of another method of detecting radiation.
Figure 17B:
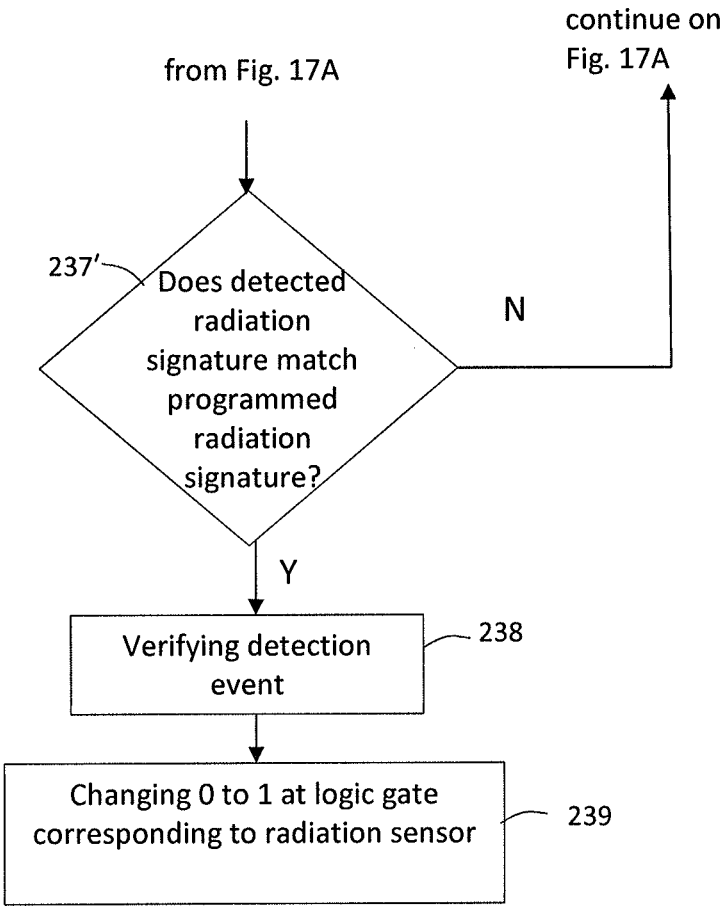

In other embodiments, as in FIGS. 17A and 17B, a radiation signature may be detected and compared to a programmed signature for verification. These embodiments follow the signature method described above. For instance, a method for detecting radiation, as at 230', includes scanning for radiation, as at 231. If radiation is detected, as at 232, then each radiation detection event may be registered, as at 233. Naturally occurring radiation as well as devices containing radiation will present a known pattern within the well. With the tool measuring the quantity of radiation the processor will be able to present this data in comparison to the downhole map of the well to output the known location. The pattern of radiation detection events registered may be recorded, as at 234', as further radiation events are detected. The radiation signature may be defined as the pattern of all radiation detection events, as at 235', which may be a binary signature comprised of 1's and 0's. In other embodiments of the method 230', the radiation levels are measured, as at 234", and the magnetic signature is defined as the pattern of radiation levels detected over a defined distance, as at 235". Once a radiation signature is defined, it is compared to the programmed radiation signature, as at 236'. If they match, as at 237', then radiation detection is verified, as at 238, and a signal is sent to the corresponding logic gate for the radiation sensor to change from a 0 to a 1, as at 239. If the detected radiation signature does not match the programmed signature, then the sensor continues scanning for radiation, as at 231.

Figure 18:
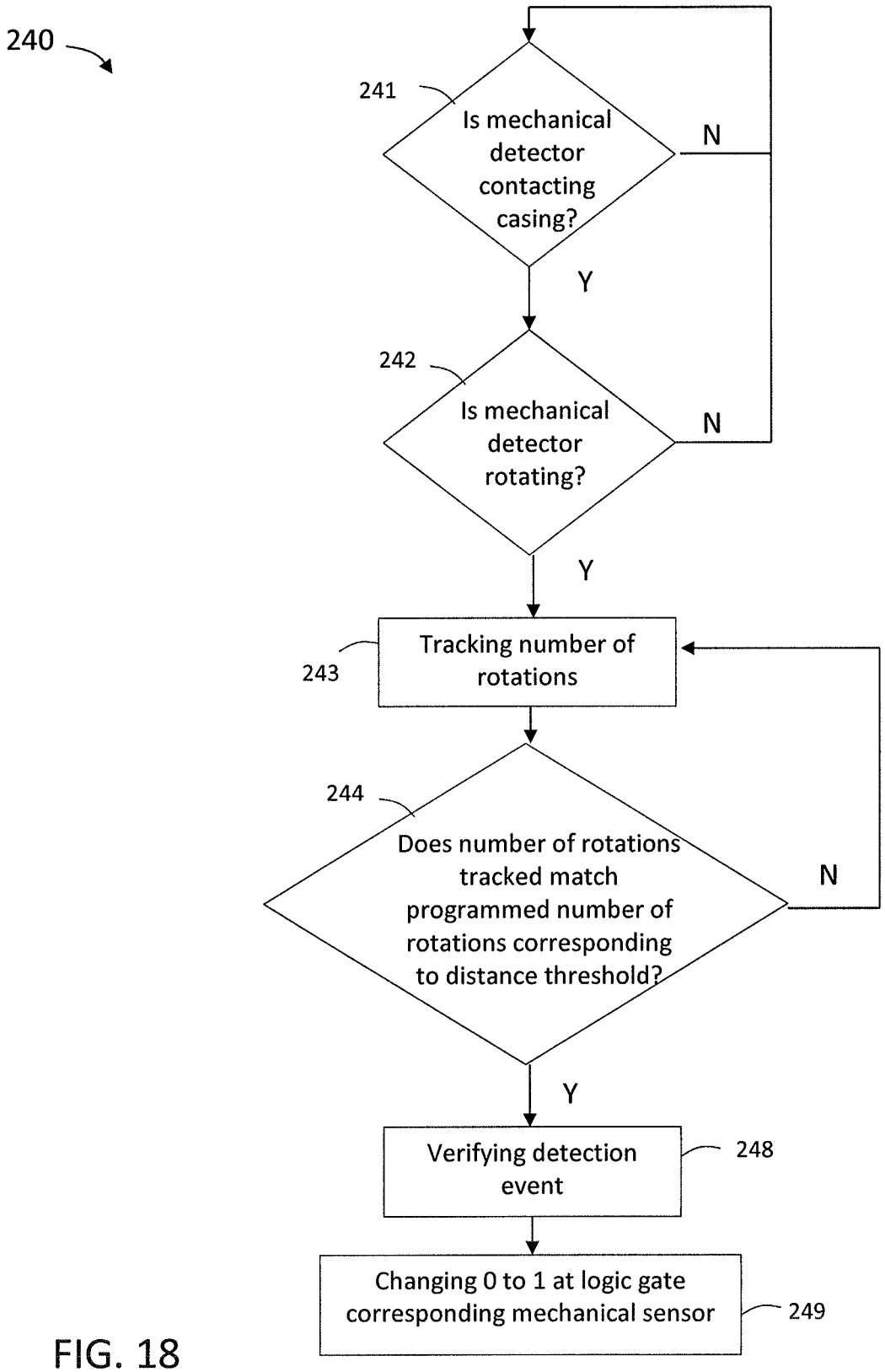
FIG. 18 is a schematic diagram of a method of detecting the mechanical property of distance.

FIG. 18 shows a method for detecting a mechanical property, as at 240. Specifically, a distance traveled is determined with the use of a rotating mechanical sensor, such as a distance wheel. The method 240 may include making sure the mechanical sensor is contacting the casing, as at 241, and that the mechanical sensor is rotating, as at 242. Once it is rotating, the mechanical sensor tracks the number of full rotations, as at 243. The number of rotations may be compared to a number of rotations corresponding to a distance threshold that has been programmed into the processor. Well depths are typically between 100 feet and 30,000 feet or more. Downhole activity can occur at any depth but generally occur starting at the furthest point of the wellbore and working up through the majority of the wellbore. If the number of rotations matches the programmed number of rotations, as at 244, or otherwise indicates a number of rotations that meets the corresponding distance threshold, then the distance parameter is verified, as at 248, and a signal is sent to change the logic gate for the mechanical sensor from 0 to 1, as at 249. If the number of rotations fails to match the programmed number of rotations or to correspond to the distance threshold, then the mechanical sensor continues tracking rotations, as at 243. This is but one example for use with a rotating mechanical sensor, such as a distance wheel. A digital distance counter could be used as a mechanical sensor, in which case contact with the casing and the number of rotations would not be needed, but rather the actual distance data logged by the device would be compared to a distance threshold. In further embodiments, the distance threshold may simply be defined as a particular distance, or a distance from a known point in the well.

Figure 19A:
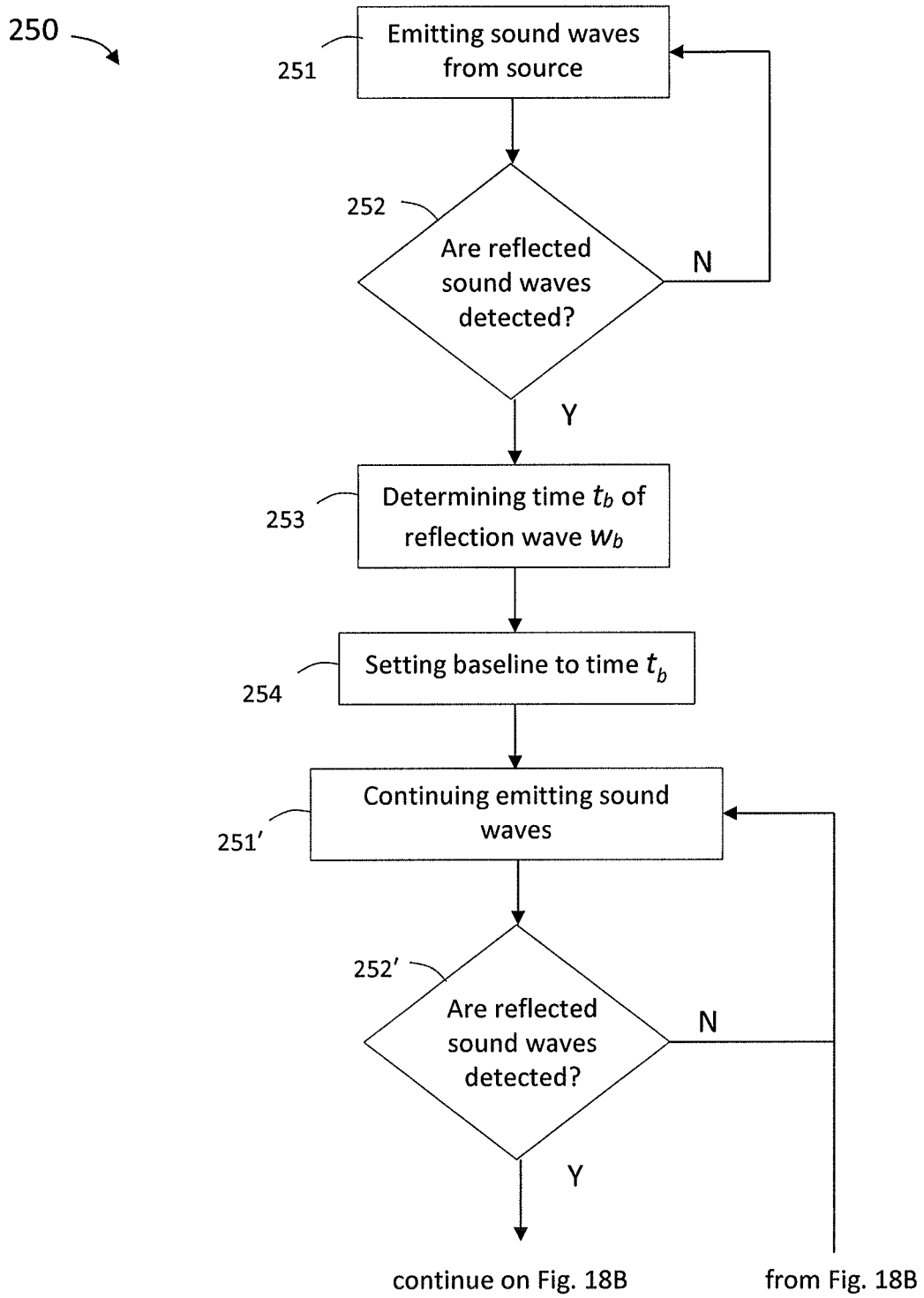
FIGS. 19A and 19B collectively show a schematic diagram of a method of detecting sound.
Figure 19B:
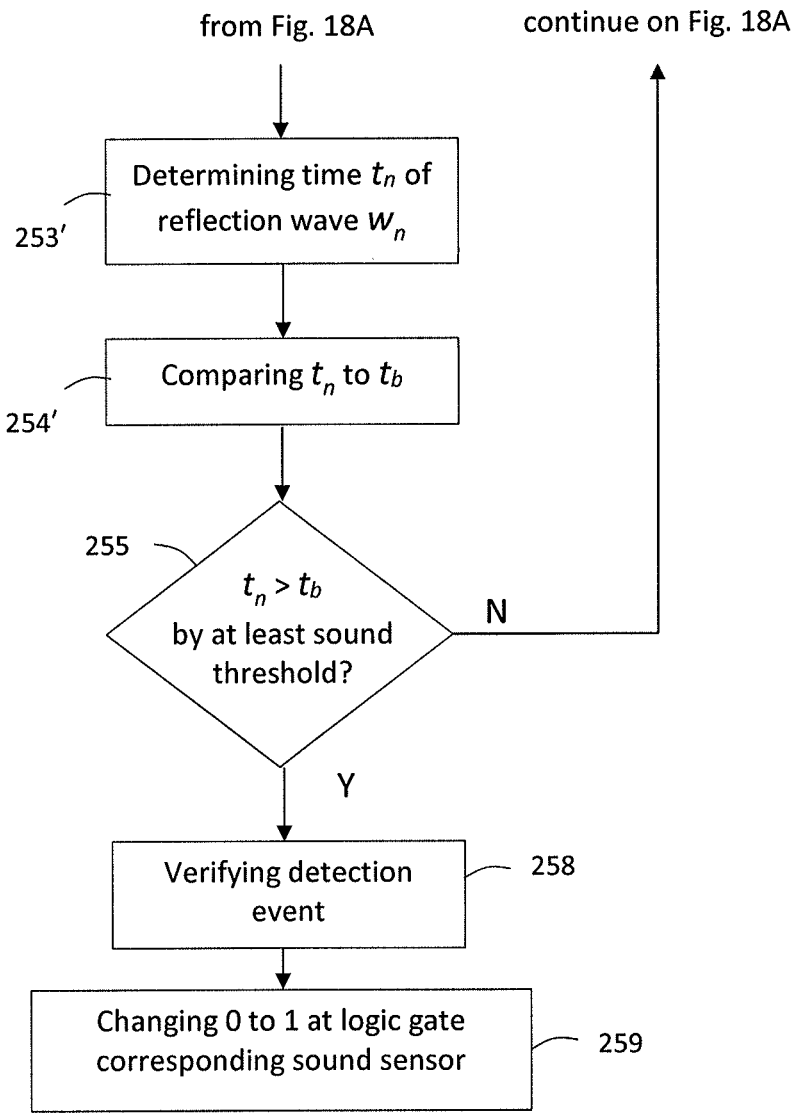

FIGS. 19A and 19B show a method of detecting a sonic property, as at 250. Such methods may be used with ultrasonic or sound transducer commonly used in casing thickness measurement tools. As used herein, sound waves and properties include ultrasonic waves and properties as well as mechanical vibrations as previously described. The method 250 includes emitting sonic waves from a source, as at 251. The sensor may be the sound source, and may be a transducer or like device. The sound waves are reflected back to the sensor/transducer, and the amount of time it takes to receive the reflected wave will vary depending on the thickness of the material it passed through in reflecting. Less time is required to reflect through thinner materials, and more time is required to reflect through thicker materials. When the initial sound waves are reflected back and detected, as at 252, the time $t_b$ it took for the reflected wave $w_b$ to reach the sensor is determined, as at 253. This time $t_b$ is set as the baseline, as at 254. For example, ultrasonic sound waves travel at approximately 1500 meters (59,055.15 inches) per second in water and 5000 meters (196,850.5 inches) per second in steel. With a tool standoff from the wellbore of 0.75 inches and with a normal thickness of 0.25 inches the travel time for each interface would be 0.75 inches in water $2.54\times10^{-5}$ seconds to account for the travel time to and from. Adding the steel time on a normal collar at 0.25 inches is $2.54\times10^{-6}$. This is the travel time that would be cut in half if the thickness was 0.125 inches as may be found at a collar with the casing having internal threading, since the threads are thinner pieces of metal and therefore require less time for reflection waves. Thus a device may begin detecting at a time just after the water arrival at $2.54\times10^{-5}$ seconds. A baseline may be established at $2.54\times10^{-6}$ seconds later where any value flagged at less than 25% of that time triggers a detectable event less than the baseline.

The sensor continues emitting sound waves, as at 251', once the baseline is established and the device 30 continues on its path through the wellbore. When further sound waves are detected, as at 252', the reflection time $t_n$ for the newly detected reflected wave $w_n$ is determined, as at 253'. The reflection time $t_n$ is compared to the baseline time $t_b$, as at 254'. If the reflection time $t_n$ is greater than the baseline time $t_b$ by at least a sound threshold, as at 255, then sound detection is verified, as at 258, and a signal is sent to the logic gate for the sound sensor changing the logic gate from 0 to 1, as at 259. As with other thresholds, the sound threshold may be any detectable level of sound, and may vary depending on the particular sound, source, frequency, or type of sensor used. If the reflection time $t_n$ is less than the baseline time $t_b$, or is greater than but not by the sound threshold, then sound detection is not verified and the sensor continues emitting ultrasonic waves.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. An interlock system for use within a wellbore, comprising:

a housing to be inserted in said wellbore;

a plurality of sensors each mounted within said housing and each selected from the group consisting of:

(i) an absolute locational sensor for detecting the proximity of at least one corresponding location identifier, generating an electronic signal indicative of said proximity, and one of:

(a) receiving an authentication code from at least one location identifier when in proximity to said at least one location identifier and generating an electronic signal indicative of said authentication code; and (b) incorporating an RFID transducer capable of detecting a unique identifying code from each of at least two location identifiers and generating an electronic signal indicative of each of said unique identifying codes; and (ii) a relative locational sensor for one of:

(a) detecting a distance traveled by said housing and generating an electronic signal indicative of said distance; and (b) detecting a pulse representative of a coded message transmitted in at least one of well mud and a casing and generating an electronic signal indicative of said coded message;

a processor mounted within said housing and in electronic communication with each of said plurality of sensors, said processor configured to:

(i) receive said electronic signals from said sensors;

(ii) derive location information of said housing within said wellbore from said electronic signals;

(iii) compare said location information to preselected reference information for corresponding ones of said sensors;

(iv) verify the location of said housing within said wellbore when said derived location information equivalent to said preselected reference information for said corresponding sensor; and (v) at least one of:

(a) change the state of a logic gate corresponding to each of said plurality of sensors when said location of said housing has been verified for said corresponding sensor;

(b) derive a PIN corresponding to each of said unique identifying codes, compare each said PIN to preselected reference information for each of said at least two location identifies, and verify said location of said housing when all of said unique identifying codes and said PINs are equivalent to corresponding ones of said preselected reference information;

(c) receive velocity information from an accelerometer in electronic communication with said processor, calculate an activation time based on said velocity and set a timer for said activation time; and (d) convert said coded message to said location information of said housing; and (vi) generate a trigger signal when one of the following conditions is detected;

(a) at least two different ones of said location information corresponding to said sensors is verified; and (b) said timer has expired; and an activation mechanism in electrical communication with said processor and configured to activate downhole event upon receiving said trigger signal from said processor; and a power supply mounted within said housing and in electrical communication with said processor and said plurality of sensors.

2. The interlock system of claim 1, wherein one of said plurality of sensors is configured to detect a physical condition selected from the group consisting of radio-frequency, magnetic field, electrical property, radiation, ultrasound, sound, distance, velocity, pressure, temperature, and spatial orientation.

3. The interlock system of claim 1, wherein said reference information is at least one of a radio-frequency signal, an RFID tag sequence, an authentication code, a magnetic field, a magnetic signature, an electrical property, radiation, a radiation signature, a time of a reflectance wave, a physical property threshold, a predetermined number of detection events, and a location.

4. The interlock system of claim 1, wherein said at least one location identifier is located in one of said wellbore, a casing disposed within said wellbore, a node within said casing, and strata surrounding said wellbore.

5. The interlock system of claim 1 wherein said processor is configured to compare said authentication code to said preselected reference information.

6. The interlock system of claim 1, wherein said processor is isolated from any external communication device.

7. The interlock system of claim 1, wherein one of said plurality of sensors is configured to detect a magnetic field.

8. The interlock system of claim 7, wherein one of said plurality of sensors is configured to detect a magnetic signature.

9. The interlock system of claim 1, wherein one of said plurality of sensors is configured to detect radiation.

10. The interlock system of claim 9, wherein one of said plurality of sensors is configured to detect a radiation signature.

11. The interlock system of claim 1, wherein said downhole event is one of: (i) detonation of explosive material, (ii) perforating a casing, (iii) setting a plug, (iv) releasing an item, and (v) activating a tool.

12. The interlock system of claim 1, wherein said coded message includes the time said pulse was generated at a location distant from said relative locational sensor.

13. The interlock system of claim 1, wherein said housing is one of a perforating gun housing, a plug housing, an item, and a tool.

14. The interlock system of claim 1, wherein said interlock system is mounted to equipment for deployment down a wellbore.

15. The interlock system of claim 14, wherein said equipment is at least one of a perforating gun, plug, an item, and a tool.

16. A method for using an interlock system within a wellbore, comprising:

programming a processor with preselected reference information for each of a plurality of sensors and one of:

(i) said preselected reference information including a baseline and a change threshold for each of a plurality of sensors; and (ii) preselected code information;

deploying a device having said plurality of sensors and said programmed processor into said wellbore;

registering detection events by said plurality of sensors, including:

(i) detecting proximity of one of said sensors to a corresponding location identifier;

(ii) generating an electronic signal indicative of said proximity;

(iii) performing one of:

(a) detecting a physical condition with one of said plurality of sensors and generating an electronic signal indicative of said physical condition;

(b) detecting a physical condition with one of said plurality of sensors, defining a signature representing said physical condition and generating an electronic signal indicative of said signature;

(c) determining a distance traveled by said device and generating an electronic signal indicative of said distance traveled;

(d) detecting a pulse representative of a coded message transmitted in at least one of well mud and a casing, and generating an electronic signal indicative of said pulse;

(iv) receiving said electronic signals from said plurality of sensors;

(v) deriving location information of said device from said electronic signals;

verifying said detection events by comparing said location information to said preselected reference information of said corresponding one of said sensors, verifying the location of said device when said derived location information is equivalent to said preselected reference information for said corresponding one of said sensors, and one of:

(i) comparing said location information to said preselected reference information, changing a logic a rte corresponding to different ones of said plurality of sensors from 0 to 1 when said derived location information for said corresponding one of said sensors is equivalent to said preselected reference information and verifying the detection event when said logic gate is set to 1;

(ii) comparing said physical condition to said preselected reference information and verifying the detection event when said physical condition detected exceeds said baseline by at least said change threshold;

(iii) comparing said signature to said programmed reference information for said corresponding one of said plurality of sensors and verifying the detection event when said signature is equivalent to said programmed reference information for said corresponding one of said plurality of sensors; and (iv) decoding said coded message by comparing said electronic signal indicative of said pulse to said preselected code information and verifying the location of said device based on the contents of said decoded message; and generating a trigger signal when at least two detection events are verified and one of:

(i) activating a downhole event upon generation of said trigger signal; and (ii) calculating an activation time once at least two detection events are verified, setting a timer for said activation time, and activating a downhole event upon expiration of said timer.

17. The method of claim 16, wherein registering detection events further comprises:

(i) registering a first detection event with a first sensor at a corresponding first location identifier; and (ii) registering a second detection event with a second sensor at a corresponding second location identifier.

18. The method of claim 16, wherein generating a trigger signal occurs when two logic gates are at 1.

19. The method of claim 16, wherein registering detection events further comprises:

(i) registering each time said plurality of sensors either detects proximity to a corresponding location identifier or measures distance traveled;

(ii) totaling all detection events;

(iii) comparing said total detection events to said programmed reference information for said corresponding one of said plurality of sensors; and (iv) defining said verified detection event for said corresponding one of said plurality of sensors when said total detection events is equivalent to said programmed reference information for said corresponding one of said plurality of sensors.

20. The method of claim 16, wherein said signature is unique to said corresponding location identifier.

21. The method of claim 16, wherein said coded message includes the time said pulse was generated at a location distant from said plurality of sensors.

22. The method of claim 21, wherein detecting a pulse representative of a coded message includes recording a time said pulse was detected; and wherein deriving location information includes comparing said time said pulse was generated to said time said pulse was detected.

* * * * *